US007857514B2

(12) United States Patent
Gaikwad et al.

(10) Patent No.: US 7,857,514 B2
(45) Date of Patent: Dec. 28, 2010

(54) RESEALABLE CLOSURES, POLYMERIC PACKAGES AND SYSTEMS AND METHODS RELATING THERETO

(75) Inventors: Sanjeev Gaikwad, Hinckley, OH (US); Paul A. Tilman, Sherwood, WI (US)

(73) Assignee: Reynolds Foil Inc., Richmond, VA (US)

( * ) Notice: Subject to any disclaimer, the term of this patent is extended or adjusted under 35 U.S.C. 154(b) by 1050 days.

(21) Appl. No.: 11/609,809

(22) Filed: Dec. 12, 2006

(65) Prior Publication Data

US 2008/0138459 A1 Jun. 12, 2008

(51) Int. Cl.
*B65D 33/16* (2006.01)
*B65D 33/01* (2006.01)
*A44B 1/04* (2006.01)
*A44B 19/00* (2006.01)

(52) U.S. Cl. ..... 383/59; 383/63; 383/100; 24/30.5 R; 24/389; 24/585.12; 24/DIG. 50

(58) Field of Classification Search ..... 383/59, 383/63, 64, 100, 103; 24/30.5 R, 389, 585.12, 24/DIG. 50
See application file for complete search history.

(56) References Cited

U.S. PATENT DOCUMENTS

| | | | | |
|---|---|---|---|---|
| 2,142,970 | A | 1/1939 | Anderson | 137/146 |
| 2,385,176 | A | 9/1945 | White | 33/50 |
| 2,576,322 | A | 11/1951 | Waters | 229/62.5 |
| 2,778,171 | A | 1/1957 | Taunton | 53/9 |
| 2,778,173 | A | 1/1957 | Taunton | 53/22 |
| 2,870,954 | A | 1/1959 | Kulesza | 229/62.5 |
| 2,913,030 | A | 11/1959 | Fisher | 150/52 |
| 2,946,502 | A | 7/1960 | Metzger | 229/62.5 |
| 3,054,551 | A | 9/1962 | Holbrook et al. | 229/86 |
| 3,176,364 | A * | 4/1965 | Dritz | 24/304 |
| 3,224,574 | A | 12/1965 | McConnell et al. | 206/56 |
| 3,440,696 | A | 4/1969 | Staller | |
| 3,591,870 | A | 7/1971 | Friesen et al. | 4/110 |
| 3,823,750 | A | 7/1974 | Owen | 141/65 |
| 3,949,934 | A | 4/1976 | Goglio | 383/103 |
| 3,980,226 | A | 9/1976 | Franz | 383/71 |
| 4,016,999 | A | 4/1977 | Denzer | 220/231 |
| 4,051,971 | A | 10/1977 | Saleri et al. | 215/260 |
| 4,105,491 | A | 8/1978 | Haase et al. | 156/553 |
| RE30,045 | E | 7/1979 | Greene | 206/455 |
| 4,267,960 | A | 5/1981 | Lind et al. | 383/106 |

(Continued)

FOREIGN PATENT DOCUMENTS

| | | |
|---|---|---|
| JP | 3212355 | 9/1991 |

(Continued)

OTHER PUBLICATIONS

International Search Report for PCT Application No. PCT/US2005/26070, which claims priority to U.S. Appl. No. 11/186,131.

(Continued)

*Primary Examiner*—Jes F Pascua
(74) *Attorney, Agent, or Firm*—Greenberg Traurig, LLP

(57) ABSTRACT

Resealable closures for use in sealing polymeric packages are provided. The resealable closures include a sealant material that restricts fluid flow into and out of the resealable closure.

13 Claims, 21 Drawing Sheets

U.S. PATENT DOCUMENTS

| | | | | | |
|---|---|---|---|---|---|
| 4,295,566 | A | | 10/1981 | Vincek | 206/457 |
| 4,310,118 | A | | 1/1982 | Kisida et al. | 383/102 |
| 4,337,804 | A | | 7/1982 | Maruscak | 141/65 |
| 4,340,558 | A | | 7/1982 | Hendrickson | 264/151 |
| 4,354,541 | A | | 10/1982 | Tilman | 383/63 |
| 4,571,924 | A | | 2/1986 | Bahrani | 53/453 |
| 4,601,410 | A | | 7/1986 | Bond | 222/92 |
| 4,620,320 | A | | 10/1986 | Sullivan | 383/203 |
| 4,690,667 | A | | 9/1987 | Domke | 493/213 |
| 4,702,376 | A | | 10/1987 | Pagliaro | 206/524.8 |
| 4,715,494 | A | | 12/1987 | Heitzenroder et al. | 206/213.1 |
| 4,731,978 | A | | 3/1988 | Martensson | 53/468 |
| 4,756,140 | A | | 7/1988 | Gannon | 53/434 |
| 4,761,080 | A | | 8/1988 | Schirmer | 383/120 |
| 4,791,710 | A | * | 12/1988 | Nocek et al. | 24/585.12 |
| 4,838,429 | A | | 6/1989 | Fabisiewicz et al. | 383/205 |
| 4,841,603 | A | * | 6/1989 | Ragni | 24/584.1 |
| 4,890,935 | A | | 1/1990 | Ausnit et al. | 383/59 |
| 4,892,414 | A | | 1/1990 | Ausnit | 383/63 |
| 4,954,124 | A | | 9/1990 | Erickson et al. | 493/195 |
| 4,986,673 | A | | 1/1991 | Bell | 383/204 |
| 5,053,091 | A | | 10/1991 | Giljam et al. | 156/66 |
| 5,059,036 | A | | 10/1991 | Richison et al. | 383/61.2 |
| 5,215,275 | A | | 6/1993 | Gold | 493/194 |
| 5,228,271 | A | | 7/1993 | Wallace | 53/434 |
| 5,240,112 | A | | 8/1993 | Newburger | 206/524.8 |
| 5,246,114 | A | | 9/1993 | Underwood | 206/524.8 |
| 5,252,281 | A | | 10/1993 | Kettner et al. | 264/173.17 |
| 5,287,680 | A | | 2/1994 | Lau | 53/512 |
| 5,293,672 | A | | 3/1994 | Tominaga et al. | 24/585.1 |
| 5,332,095 | A | | 7/1994 | Wu | 206/524.8 |
| 5,333,736 | A | | 8/1994 | Kawamura | 206/524.8 |
| 5,351,369 | A | | 10/1994 | Swain | 24/304 |
| 5,388,910 | A | | 2/1995 | Koyanagi | 383/100 |
| 5,403,094 | A | | 4/1995 | Tomic | 383/63 |
| RE34,929 | E | | 5/1995 | Kristen | 206/524.8 |
| 5,439,631 | A | | 8/1995 | Schneider et al. | 264/293 |
| 5,450,963 | A | | 9/1995 | Carson | 206/524.8 |
| 5,480,030 | A | | 1/1996 | Sweeney et al. | 206/524.8 |
| 5,540,500 | A | | 7/1996 | Tanaka | 383/43 |
| 5,544,752 | A | | 8/1996 | Cox | 206/524.8 |
| 5,554,093 | A | | 9/1996 | Porchia et al. | 493/240 |
| 5,554,423 | A | | 9/1996 | Abate | 428/35.2 |
| 5,558,439 | A | | 9/1996 | Tilman | 383/63 |
| 5,588,187 | A | * | 12/1996 | Swain | 24/581.11 |
| 5,618,111 | A | | 4/1997 | Porchia et al. | 383/63 |
| 5,665,408 | A | | 9/1997 | Coupe et al. | 426/113 |
| 5,735,317 | A | | 4/1998 | Wu | 141/65 |
| 5,804,265 | A | | 9/1998 | Saad et al. | 428/35.2 |
| 5,829,884 | A | | 11/1998 | Yeager | 383/45 |
| 5,839,582 | A | | 11/1998 | Strong et al. | 206/524.8 |
| 5,839,831 | A | | 11/1998 | Mazzocchi | 383/65 |
| 5,878,468 | A | | 3/1999 | Tomic et al. | 24/585.12 |
| 5,881,881 | A | | 3/1999 | Carrington | 206/524.8 |
| 5,894,929 | A | | 4/1999 | Kai et al. | 206/524.8 |
| 5,931,189 | A | | 8/1999 | Sweeney et al. | 137/512.15 |
| 5,948,337 | A | | 9/1999 | Sakakibara et al. | 264/167 |
| 5,954,196 | A | | 9/1999 | Lin | 206/286 |
| 5,996,800 | A | | 12/1999 | Pratt | 206/524.8 |
| 6,004,032 | A | | 12/1999 | Kapperman et al. | 383/5 |
| 6,020,013 | A | | 2/2000 | Kozma | 426/393 |
| 6,021,624 | A | | 2/2000 | Richison et al. | 53/410 |
| 6,036,796 | A | | 3/2000 | Halbert et al. | 156/64 |
| 6,039,182 | A | | 3/2000 | Light | 206/524.8 |
| 6,045,264 | A | * | 4/2000 | Miniea | 383/41 |
| 6,059,457 | A | | 5/2000 | Sprehe et al. | 383/63 |
| 6,070,397 | A | | 6/2000 | Bachhuber | 53/512 |
| 6,070,728 | A | | 6/2000 | Overby et al. | 206/524.8 |
| 6,085,906 | A | | 7/2000 | Lambert | 206/524.8 |
| 6,110,090 | A | | 8/2000 | Ausnit | 493/212 |
| 6,116,781 | A | | 9/2000 | Skeens | 383/100 |
| 6,120,817 | A | | 9/2000 | Archibald et al. | 426/106 |
| 6,149,304 | A | | 11/2000 | Hamilton et al. | 383/62 |
| 6,152,600 | A | | 11/2000 | Tomic | 383/63 |
| 6,194,011 | B1 | | 2/2001 | Glaser | 426/123 |
| 6,231,236 | B1 | | 5/2001 | Tilman | 383/61.2 |
| 6,277,547 | B1 | | 8/2001 | Bourdelais et al. | 430/432 |
| 6,286,999 | B1 | | 9/2001 | Cappel et al. | 383/5 |
| 6,361,212 | B1 | | 3/2002 | Sprehe et al. | 383/63 |
| 6,371,643 | B2 | | 4/2002 | Saad et al. | 383/63 |
| 6,403,174 | B1 | | 6/2002 | Copeta | 428/34.1 |
| 6,408,872 | B1 | | 6/2002 | Skeens et al. | 137/512.15 |
| 6,439,429 | B1 | | 8/2002 | Gross | 222/92 |
| 6,499,878 | B1 | | 12/2002 | Dobreski et al. | 383/5 |
| 6,524,002 | B2 | | 2/2003 | Tomic | 383/64 |
| 6,539,691 | B2 | | 4/2003 | Beer | 53/459 |
| 6,550,223 | B2 | | 4/2003 | Xiong et al. | 53/434 |
| 6,550,966 | B1 | | 4/2003 | Saad et al. | 383/103 |
| 6,569,368 | B2 | | 5/2003 | Machacek | 264/155 |
| 6,575,191 | B2 | | 6/2003 | Skeens et al. | 137/512.15 |
| 6,578,740 | B1 | | 6/2003 | Hagihara | 222/107 |
| 6,581,253 | B2 | | 6/2003 | ErkenBrack | 24/428 |
| 6,581,641 | B2 | | 6/2003 | Skeens et al. | 137/845 |
| 6,604,634 | B2 | | 8/2003 | Su | 206/524.8 |
| 6,607,097 | B2 | | 8/2003 | Savage et al. | 222/1 |
| 6,607,764 | B1 | | 8/2003 | Keller | 426/107 |
| 6,632,021 | B2 | | 10/2003 | Bois et al. | 383/59 |
| 6,662,410 | B2 | | 12/2003 | Kolovich et al. | 24/399 |
| 6,663,283 | B1 | | 12/2003 | Cappel | 383/5 |
| 6,679,027 | B2 | | 1/2004 | Schreiter | 53/412 |
| 6,698,925 | B2 | | 3/2004 | Bentsen | 383/63 |
| 6,715,644 | B2 | | 4/2004 | Wilford | 222/95 |
| 6,729,473 | B2 | | 5/2004 | Anderson | 206/524.8 |
| 6,733,622 | B2 | | 5/2004 | McMahon et al. | 156/580.2 |
| 6,733,803 | B1 | | 5/2004 | Vidkjaer | 426/62 |
| 6,799,680 | B2 | | 10/2004 | Mak | 206/524.8 |
| 6,814,991 | B2 | | 11/2004 | Hiyoshi | 426/113 |
| 6,837,268 | B2 | | 1/2005 | Skeens et al. | 137/550 |
| 6,840,675 | B2 | | 1/2005 | Knight | 383/64 |
| 6,860,952 | B2 | | 3/2005 | Pawloski | 156/66 |
| 6,871,473 | B1 | | 3/2005 | Dutt et al. | 53/133.4 |
| 6,883,665 | B1 | | 4/2005 | Ahn | 206/524.8 |
| 6,913,803 | B2 | | 7/2005 | Peper | 428/35.2 |
| 6,932,509 | B2 | | 8/2005 | Shah et al. | 383/103 |
| 6,964,519 | B2 | | 11/2005 | ErkenBrack | 383/64 |
| 6,981,936 | B2 | | 1/2006 | Plourde et al. | 493/214 |
| 6,983,845 | B2 | | 1/2006 | Shah et al. | 206/524.8 |
| 6,991,109 | B1 | | 1/2006 | Shannon et al. | 206/524.8 |
| 7,022,058 | B2 | | 4/2006 | Lee | 493/210 |
| 7,090,397 | B2 | * | 8/2006 | Stolmeier | 383/64 |
| 7,137,738 | B2 | | 11/2006 | Shah et al. | 383/103 |
| 7,138,025 | B2 | | 11/2006 | Wu et al. | 156/204 |
| 7,290,660 | B2 | | 11/2007 | Tilman et al. | 206/524.8 |
| 7,316,101 | B1 | * | 1/2008 | Nguyen et al. | 53/408 |
| 7,437,805 | B2 | * | 10/2008 | Berich | 24/399 |
| 7,765,649 | B2 | * | 8/2010 | Katada et al. | 24/30.5 R |
| 2003/0000180 | A1 | | 1/2003 | Singer | 53/512 |
| 2003/0024847 | A1 | | 2/2003 | Malaspina | 206/524.8 |
| 2003/0037519 | A1 | | 2/2003 | Ishizaki | 55/374 |
| 2003/0102245 | A1 | | 6/2003 | Wang | 206/524.8 |
| 2003/0118759 | A1 | | 6/2003 | Yoshikawa et al. | 428/35.2 |
| 2003/0136798 | A1 | | 7/2003 | Wilford | 222/107 |
| 2003/0155269 | A1 | | 8/2003 | Lee | 206/524.8 |
| 2003/0169947 | A1 | | 9/2003 | Taheri | 383/5 |
| 2003/0177619 | A1 | | 9/2003 | Cisek | 24/585.12 |
| 2004/0000501 | A1 | | 1/2004 | Shah et al. | 206/524.8 |
| 2004/0000503 | A1 | | 1/2004 | Shah et al. | 206/524.8 |
| 2004/0007494 | A1 | | 1/2004 | Popeil et al. | 206/524.8 |
| 2004/0050745 | A1 | | 3/2004 | Lee et al. | 206/524.8 |
| 2004/0057636 | A1 | | 3/2004 | Ishizaki | 383/44 |
| 2004/0091179 | A1 | | 5/2004 | Anderson | 383/63 |
| 2004/0114837 | A1 | | 6/2004 | Koyanagi | 383/103 |
| 2004/0161178 | A1 | | 8/2004 | Olechowski | 383/210.1 |
| 2004/0231294 | A1 | | 11/2004 | Shannon | 53/434 |

| | | | | |
|---|---|---|---|---|
| 2004/0256050 | A1 | 12/2004 | Wu | 156/192 |
| 2005/0022472 | A1 | 2/2005 | Brakes et al. | 53/434 |
| 2005/0035020 | A1 | 2/2005 | Wu et al. | 206/524.8 |
| 2005/0036717 | A1 | 2/2005 | Wu et al. | 383/63 |
| 2005/0036718 | A1 | 2/2005 | Wu et al. | 383/103 |
| 2005/0036719 | A1 | 2/2005 | Wu et al. | 383/105 |
| 2005/0037163 | A1 | 2/2005 | Wu et al. | 428/34.2 |
| 2005/0037164 | A1 | 2/2005 | Wu et al. | 428/34.2 |
| 2005/0065007 | A1 | 3/2005 | Wu et al. | 493/191 |
| 2005/0143243 | A1 | 6/2005 | Lee | 493/186 |
| 2005/0147330 | A1 | 7/2005 | Lee | 383/116 |
| 2005/0147774 | A1 | 7/2005 | Lee | 428/34.1 |
| 2005/0157957 | A1 | 7/2005 | Turvey et al. | 383/33 |
| 2005/0172577 | A1 | 8/2005 | Oltrogge | 53/434 |
| 2005/0173053 | A1 | 8/2005 | Ichikawa et al. | 156/251 |
| 2005/0178691 | A1 | 8/2005 | Frenkil | 206/524.8 |
| 2005/0205455 | A1 | 9/2005 | Harrison | 206/524.8 |
| 2005/0220373 | A1 | 10/2005 | Wu | 383/105 |
| 2005/0220942 | A1 | 10/2005 | Wu et al. | 426/124 |
| 2005/0244083 | A1 | 11/2005 | McMahon et al. | 383/63 |
| 2005/0286808 | A1 | 12/2005 | Zimmerman et al. | 383/43 |
| 2005/0286813 | A1 | 12/2005 | Borchardt | 383/63 |
| 2006/0013514 | A1 | 1/2006 | Wu | 383/109 |
| 2006/0029299 | A1 | 2/2006 | Share et al. | 383/63 |
| 2006/0030472 | A1 | 2/2006 | Hartman et al. | 493/213 |
| 2006/0048483 | A1 | 3/2006 | Tilman et al. | |
| 2006/0073291 | A1 | 4/2006 | Wu | 428/35.2 |
| 2006/0093242 | A1 | 5/2006 | Anzini et al. | 383/63 |
| 2006/0110079 | A1 | 5/2006 | Zimmerman et al. | 383/103 |
| 2006/0111226 | A1 | 5/2006 | Anzini et al. | 493/214 |
| 2006/0157140 | A1 | 7/2006 | Bergman et al. | 141/65 |
| 2006/0159576 | A1 | 7/2006 | Bergman et al. | 417/572 |
| 2006/0182371 | A1 | 8/2006 | Borchardt | 383/44 |
| 2006/0193540 | A1 | 8/2006 | Borchardt | 383/44 |
| 2006/0225787 | A1 | 10/2006 | Newrones et al. | 137/246 |
| 2006/0228057 | A1 | 10/2006 | Newrones et al. | 383/103 |
| 2006/0257054 | A1 | 11/2006 | Henn et al. | 383/38 |
| 2007/0092167 | A1 | 4/2007 | Tilman et al. | 383/64 |
| 2007/0101682 | A1 | 5/2007 | Tilman et al. | 426/393 |
| 2007/0101685 | A1 | 5/2007 | Tilman et al. | 383/63 |
| 2007/0110340 | A1 | 5/2007 | Buchman | 383/64 |
| 2007/0122573 | A1 | 5/2007 | Yasuike et al. | 428/34 |
| 2007/0154118 | A1 | 7/2007 | Tilman et al. | 383/63 |
| 2007/0172157 | A1 | 7/2007 | Buchman | 383/63 |
| 2007/0266532 | A1 | 11/2007 | Katada et al. | |

FOREIGN PATENT DOCUMENTS

| | | |
|---|---|---|
| JP | 4242544 | 8/1992 |
| JP | 8198274 | 8/1996 |
| JP | 8301358 | 11/1996 |
| JP | 10139050 | 5/1998 |
| JP | 2000118540 | 4/2000 |
| JP | 2006082872 | 3/2006 |
| WO | WO9413556 | 6/1994 |
| WO | WO9833717 | 8/1998 |
| WO | WO0246044 | 6/2002 |
| WO | WO2005002976 | 1/2005 |
| WO | WO2005012107 | 2/2005 |
| WO | WO2005016774 | 2/2005 |
| WO | WO2005040005 | 5/2005 |
| WO | WO2006038578 A1 | 4/2006 |
| WO | WO2006078387 | 7/2006 |
| WO | WO2006078392 | 7/2006 |
| WO | WO2006127739 | 11/2006 |
| WO | WO2006130384 | 12/2006 |
| WO | WO2007001469 | 1/2007 |

OTHER PUBLICATIONS

International Preliminary Examination Report for PCT Application No. PCT/US2005/26070, which claims priority to U.S. Appl. No. 11/186,131.

Written Opinion of the International Search Authority for PCT Application No. PCT/US2005/26070, which claims priority to U.S. Appl. No. 11/186,131.

International Preliminary Report on Patentability and Written Opinion for PCT Application No. PCT/US2005/029632, which claims priority to U.S. Appl. No. 11/186,131.

Advertisement for Sealit Vac'N Zip, retrieved from the Internet on Feb. 2, 2006, from www.sealit.tv (domain name no longer active as of Apr. 16, 2007).

U.S. Appl. No. 11/782,884, entitled, "Polymeric Package With Resealable Closure and Valve, and Methods", to Tilman et al., filed Jul. 25, 2007.

U.S. Appl. No. 11/740,919, entitled, "Polymeric Package With Resealable Closure and Valve and Methods Relating Thereto", to Tilman et al., filed Apr. 26, 2007.

U.S. Appl. No. 11/660,474, entitled, "High-Integrity Closure", to Tilman et al., filed Feb. 16, 2007 (Corresponds with WO2006/023776).

* cited by examiner

RESEALABLE CLOSURES, POLYMERIC PACKAGES AND SYSTEMS AND METHODS RELATING THERETO

FIELD OF THE INVENTION

The present invention relates to resealable closures utilized with polymeric packages. The resealable closures facilitate a substantially air-tight seal.

BACKGROUND OF THE INVENTION

Many consumer packaging applications employ reclosable polymeric packages, such as reclosable bags. These bags may employ a resealable closure for sealing products within the bags. For example, a zipper-type resealable closure may include male and female profiles extending along the length of the zipper. A male profile, typically tree-shaped with an expanded head portion supported by a narrower trunk portion, is typically disposed opposite a mating female profile that is adapted to mate with the male profile by a pair of legs having locking edges or cornered shoulders. These profiles are interlocked by properly aligning the male and female profiles and pressing them together along the length of the zipper. The opposing legs of the female profile slide over the expanded head portion of the male, thereby interlocking the female profile to the head of the male profile via the cornered shoulders and resting in the trunk portion.

The interlocking fit of the male and female profiles must fulfill at least two competing requirements in that the interconnection between the male and female profiles should be snug enough to impede passage of gases and liquids therethrough, but the fit also must be substantially loose to allow ease of separation of the male and female profiles by a consumer (e.g., using typical hand opening forces). These competing requirements are generally required to be consistenyl satisfied over a broad range of service temperatures and during the entire life of the package. Thus, despite the snug fit generally provided by such resealable closures, gases (e.g., air), and sometimes liquids, may nonetheless flow into and/or out of the reclosable polymeric packages via gaps between the male and female profiles of the resealable closure. This flow is undesired in various instances, such as when food product is stored within the package, or when it is desirable to maintain a vacuum within the package.

SUMMARY OF THE INVENTION

In view of the foregoing, a broad objective of the present invention is to restrict flow of gases and/or liquids into and out of polymeric packages employing resealable closures.

A related objective is to restrict, and in some instances substantially prevent, flow of fluids through gaps located between complementary mating members of the resealable closure.

A further related objective is to restrict fluid flow through gaps of the resealable closure when the resealable closure is closed, but allow for repeated opening and closing of the resealable closure using normal consumer applied forces.

Yet a further related objective is to achieve restricted fluid flow over various typical service conditions and over a typical lifetime of the resealable closure.

In addressing one or more of the above objectives, the present inventors have recognized that a viscous sealant material may be utilized in conjunction with a resealable closure to restrict, and in some instances substantially prevent, flow of gases and/or liquid into and out of polymeric packages via the resealable closure. More particularly, the present inventors have recognized that a sealant material may be contained within at least a portion of one of the male profile and female profile of the resealable closure, whereupon engagement of the male profile with the female profile, at least some of the sealing material flows out of its containment and fills gaps between the male profile and the female profile. This arrangement generally facilitates a substantially air-tight seal of the resealable closure while allowing for repeated opening and closing of the resealable closure, over a various typical use conditions of the resealable closure and over the typical lifetime of the resealable closure.

In one aspect, a resealable closure is provided, the resealable closure including a first complementary member, a second complementary member adapted to interconnect with (e.g., restrainably engage) the first complementary member, and a sealant material sealed within a channel of at least one of the first and second complementary members. In one approach, the distance between the channel and a sidewall/retaining wall (e.g., a membrane) of the complementary member(s) containing the channel is sufficiently small such that upon engagement of the first and second complementary members, the sidewall and/or tip at least partially ruptures, thereby allowing the sealant material to flow out of the channel. In one approach, a weakness is provided in, or proximal to, a sidewall that is proximal the channel. Thus, upon engagement of the first and second complementary members, the weakness may be compromised (e.g., broken), thereby rupturing at least portion of the sidewall and allowing the sealant material to flow out of the channel.

In one approach, one of the complementary members comprises a male profile, and the other of the complementary members comprises a female profile. In one embodiment, the female profile comprises a restraining member adapted to restrainably engage a head of the male profile.

In one approach, the sealant material is sealed within the male profile of the resealable closure. In one embodiment, the head of the male profile comprises the channel, the channel being spaced from the sidewall and/or tip and being at partially filled with some of the sealant material. In one embodiment, the thickness of the sidewall and/or tip is such that when the head of the male profile engages the female profile at least a portion of the sidewall and/or tip ruptures, thereby allowing flow of the sealant material out of the channel. In one embodiment, a weakness may be provided in the head of the male profile to facilitate the rupturing of the sidewall.

In another approach, the sealant material may be included in the female profile, wherein the female profile includes the channel and a sidewall spaced from the channel, the channel being at least partially filled with at least some of the sealant material. In one embodiment, the thickness of the sidewall is such that when the head of the male profile engages the female profile, at least a portion of the sidewall ruptures, thereby allowing flow of the sealant material out of the channel. In one embodiment, the female profile includes a bump for facilitating rupturing of the sidewall, the bump including at least a portion of the channel and the sidewall. In one embodiment, a weakness may be provided in the bump of the female profile to facilitate the rupturing of the sidewall.

In one approach, the sealant material is contained within at least one channel, where the channel includes at least one sealant-containing portion and at least one unfilled portion (e.g., a vacant or substantially empty portion of the channel). That is, along the length of the channel is at least one portion of sealant material and at least one portion of void space. In one embodiment, the channel includes a plurality of intermittently spaced sealant-containing portions and a plurality of intermittently spaced unfilled portions. In one embodiment, the resealable closure may be aligned with a flexible material adapted to form a polymeric package where the unfilled portions of the channel are aligned with the portions of the flexible material that will be sealed to form sides of the polymeric package. Thus, sealing of the sides of a plurality of polymeric packages and manufacture of a plurality of polymeric packages, each containing a corresponding one of the resealable closures, may be facilitated.

The sealant material may be any suitable viscous sealant material that maintains its properties in the range of the service temperatures intended for the resealable closure and associated polymeric package. In one approach, the sealant material is an FDA-approved viscous sealant material adapted for at least incidental contact with food items to be contained within the polymeric package including a resealable closure. In a particular embodiment, the sealant material is a silicone-based material.

In another aspect, a polymeric package including a resealable closure is provided. In one approach, the resealable closure is utilized with a polymeric package such as a conventional zipper closure type polymeric package (e.g., reclosable bags adapted for storage of food products). In another approach, the resealable closure is utilized with an evacuable polymeric package, the evacuable polymeric package being adapted to facilitate removal of fluids therefrom. In this regard, the polymeric package may include a vacuum valve and a stand-off structure associated therewith. The resealable closure facilitates substantial air-tight sealing of the evacuable polymeric package by filling gaps between the complementary members of the resealable closure with sealant material.

In another aspect, systems including resealable closures are provided. In one approach, the systems including a polymeric package having a resealable closure, a vacuum valve, and a stand-off structure associated therewith. The systems may also include a vacuum pump. The resealable closure facilitates substantial air-tight sealing of the polymeric package by filling gaps between complementary members of the resealable closure with sealant material. The vacuum valve and stand-off structure facilitate evacuation of gases and/or liquids from the interior of the polymeric package via the vacuum pump. The sealant material of the resealable closure restricts gases and/or liquids from entering and exiting the evacuable package, thereby facilitating maintenance of the vacuum with the evacuable package.

In another aspect, methods for forming a substantially air-tight resealable closure for use with a polymeric package are provided. One method includes the step of forming complementary members (e.g., male and female profiles) of the resealable closure, creating a channel containing a sealant material within at least a portion of the complementary members, interconnecting the complementary members, and flowing the sealant material into a gap between the complementary members, thereby substantially restricting fluids (e.g., gases and/or liquids) from flowing through the gap. The complementary members may be formed by extruding the complementary members. The channel containing the sealant material may be created by co-extruding the sealant material with at least one of the complementary members. In this regard, the sealant material may be completely sealed within one or more of the complementary members prior to engagement of the complementary members. Further, the creating the channel step may be concomitant to the forming the complementary members step.

In one embodiment, the creating the channel step comprises interrupting (e.g., intermittently stopping) a co-extruding process during the extrusion of the complementary members, thereby creating void spaces within the channel. For example, the step of creating the channel containing the sealant material may include metering the sealant material into the channel created during the co-extrusion process. In turn, the metering of the sealant material may be interrupted, such as at predetermined intervals or lengths, to create at least void spaces within the channel. The void spaces of the channel may thus be at predetermined intervals or lengths, and may correspond to a width or length of the polymeric package. The method may further include the steps of bonding the resealable closure to a first polymeric panel and a second polymeric panel of a polymeric package, and interconnecting the first polymeric panel to the second polymeric panel, thereby creating a first side of the polymeric package. In this regard, the method may include, concomitant to the interconnecting the panels step, aligning the resealable closure with the polymeric panels, wherein at least one of the void spaces of the channel of the resealable closure is co-located with the first side of the polymeric package. Subsequent sides of the polymeric package may be produced in a similar manner. Thus, sealing of the sides of the polymeric package and manufacture of a plurality of polymeric packages may be facilitated.

In another approach, the interconnecting the complementary members step may include the step of engaging the complementary members. In this regard, the flowing of the sealant material into a gap between the complementary members may be concomitant to the engagement step. Thus, in one embodiment, the engagement step may include the step of rupturing a sidewall proximal the channel that contains the sealant material, thereby enabling fluid communication between the channel and the gap between the complementary members.

As may be appreciated, various ones of the above-noted aspects, approaches, and embodiments may be combined to yield various resealable closures, and various polymeric packages including such resealable closures. These and other aspects, advantages, and novel features of the invention are set forth in part in the description that follows and will become apparent to those skilled in the art upon examination of the following description and figures, or may be learned by practicing the invention.

DETAILED DESCRIPTION OF THE INVENTION

Figure 1:
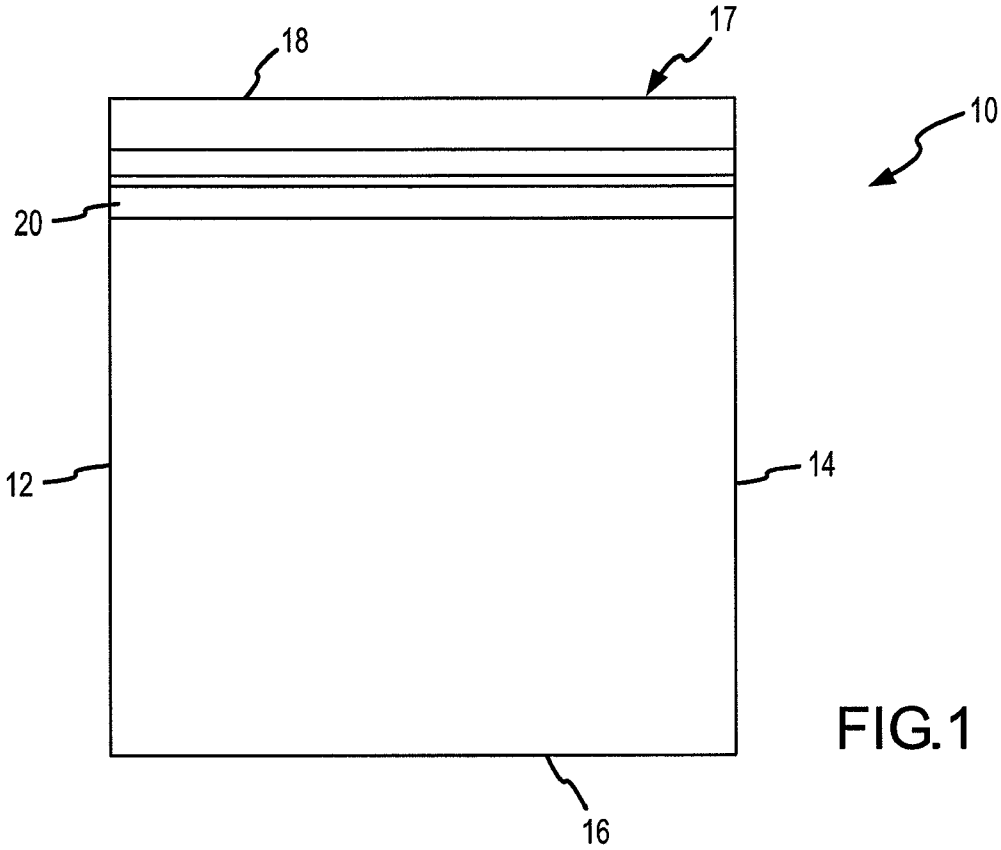
FIG. 1 is a perspective view of one embodiment of a polymeric package comprising a resealable closure.
Figure 2:
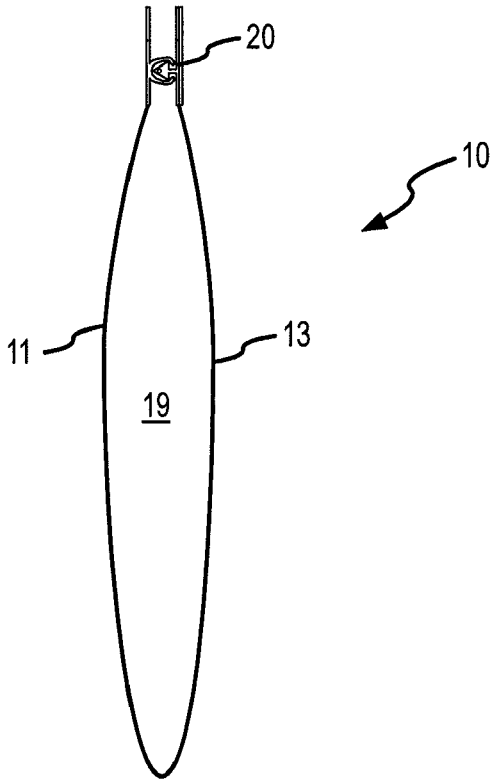
FIG. 2 is a cross-sectional, side view of the polymeric package of FIG. 1.

Reference will now be made in detail to the accompanying drawings, which at least assist in illustrating various pertinent embodiments of the present invention. One embodiment of a polymeric package including a resealable closure is illustrated in FIGS. 1 and 2. The polymeric package 10 includes a first side panel 11 and a second side panel 13 forming an interior space 19 for containment of product, such as food product. The polymeric package 10 includes a first side 12, a second side 14, and a bottom 16. The polymeric package 10 also includes a top edge 18 and an opening 17 defined by the first and second side panels 11, 13 for providing access to the interior space 19 of the polymeric package 10. The polymeric package 10 also includes a resealable closure 20 interconnected to at least one of the first and second side panels 11, 13. As discussed in further detail below, the resealable closure 20 generally includes complementary members (e.g., a male profile and a corresponding opposing female profile) to facilitate repeated opening and closing of the resealable closure 20, thereby facilitating repeated opening and closure of the polymeric package 10. The complementary members extend along the length of the resealable closure 20, thereby facilitating closure of opening 17.

The first and/or second panels 11, 13 of the polymeric package 10 generally comprise flexible materials, such as plastic sheets (e.g., polyofins) that are bonded to one another, such as via heat sealing. This heat sealing may be accomplished at the edges 12, 14 and/or bottom 16 of the polymeric package 10, thereby defining the interior space 19 of the polymeric package 10. In one embodiment, the first and second panels 11, 13 are each portions of a single plastic sheet that has been folded over, and thus the first and second panels may be integral with one another.

In one embodiment, the polymeric package 10 may be a multilayer bag comprising an inner sealant layer and a barrier/strength layer. The inner sealant layer may comprise LDPE (low density polyethylene) or LLDPE (linear low density polyethylene) and the barrier/strength layer may comprise Nylon, PP (polypropylene) or PET (polyester). For example, the low density polyethylene material may have a density of not greater than 0.925 g/cm$^3$, as defined by ASTM standard D15005-03, wherein the density may be adjusted with the addition of ethylene vinyl acetate (EVA). Another example of a multilayer bag and a method of forming a multilayer bag is described in U.S. Pat. No. 4,267,960, titled "Bag For Vacuum Packaging of Meats or Similar Products", filed Aug. 29, 1979, which is incorporated herein by reference in its entirety.

Figure 3:
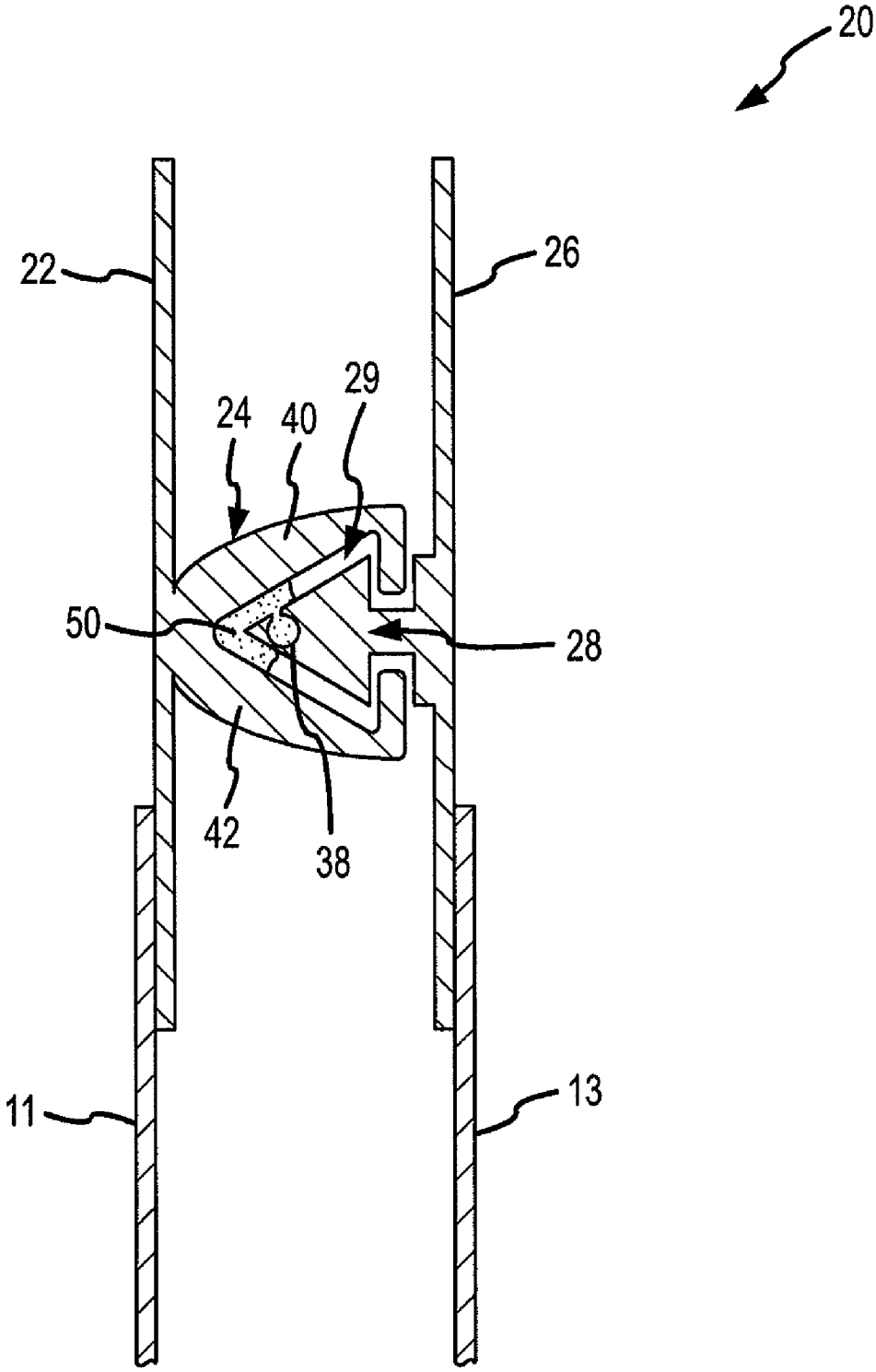
FIG. 3 is a cross-sectional, side view of the resealable closure of FIG. 1.

The resealable closure 20 facilitates sealing of the opening 17 of the polymeric package 10, thereby restricting flow of gases and/or liquids into and out of the polymeric package 10. One embodiment of such a resealable closure 20 is illustrated in FIG. 3. In the illustrated embodiment, the resealable closure 20 includes a first strip 22, which includes a female profile 24 interconnected therewith, the female profile 24 being adapted to restrainably engage at least a portion of a male profile 28 (e.g., via the illustrated arms 40, 42). The resealable closure 20 also includes a second strip 26, which includes the male profile 28 interconnected therewith, the male profile 28 being adapted to engage the female profile 24. The first strip 22 is generally bonded to the first panel 11 of the polymeric package 10, such as via an adhesive and/or a heat seal. The second strip 26 is generally bonded to the second panel 13 of the polymeric package 10, such as via an adhesive and/or a heat seal. In the illustrated embodiment, the male profile 28 includes a channel 38, which, prior to restrictive interconnection of the male profile 28 to the female profile 24, had included a sealant material 50 stored therein for sealing one or more gaps 29 between the male profile 28 and the female profile 24. As discussed in further detail below, the sealant material 50 generally comprises a viscous material, such as a silicone-containing composition, that restricts flow of liquids and/or gases into and out of the resealable closure 20 by sealing gaps 29 between the male profile 28 and the female profile 24 of the resealable closure 20.

As illustrated in FIG. 3, the sealant material 50 occupies at least some of the space of the gap 29 between the female profile 24 and the male profile 28. The sealant material 50 may be provided to the gap via any suitable technique. In one embodiment, and as described in further detail below, as the male profile 28 of the resealable closure 20 engages the female profile 24 of the resealable closure 20, a sidewall proximal the channel 38 ruptures, thereby facilitating fluid communication between the gap 29 and the channel 38. In turn, the flow of sealant material 50 from the channel 38 into the gap 29 is enabled, thereby substantially sealing the gap 29. Thus, the physical action of the male profile 28 entering the female profile 24, or vice-versa, results in pressurization and release of the sealant material 50 into the gap 29 between the male profile 28 and female profile 24.

The male and female profiles may be formed from any suitable material. For example, a male and/or female profile may comprise a polyofin material with a density of not less than approximately 0.925 g/cm$^2$, preferably those described as a high melt index (HMI) polyofin. More specifically, the male and/or female profile may comprise high melt index polyethylene materials and/or ethylene vinyl acetate copolymer, particularly those having a vinyl acetate content of from about 4 wt % to about 12 wt %. In addition, portions of the male and/or female profile and/or surrounding structures may include one or more features comprising low melt index or ultra low density (ULD) polyofins. As used herein, the term "ultra low density" denotes a density no greater than approximately 0.925 g/cm$^3$. As may be appreciated, the density may be adjusted with the addition of ethylene vinyl acetate. Various resealable closures including complementary members are known in the art and may be utilized in accordance with the teachings of the present disclosure. Some suitable resealable closures are taught in PCT Publication No. WO2006/012528, and U.S. Pat. Nos. 6,524,002; 6,152,600; 5,839,831; and 5,252,281, each of which is incorporated herein by reference in its entirety.

Figure 4:
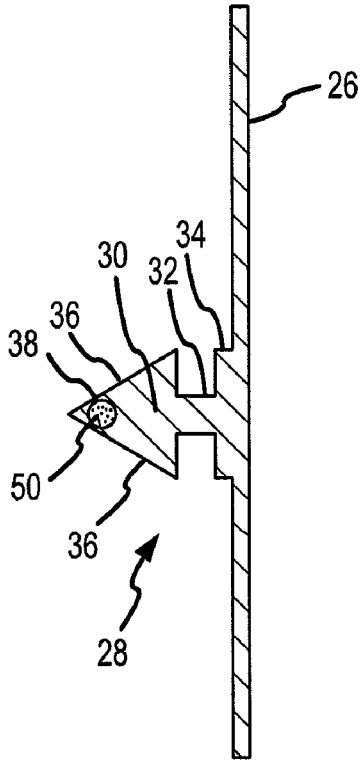
FIG. 4 is a cross-sectional, side view of one embodiment of a male profile.

One particularly useful male profile 28 is illustrated in FIG. 4. In the illustrated embodiment, the male profile 28 includes a head 30 interconnected to a stem 32, which is interconnected to a base 34, which is interconnected to the second strip 26. The head 30 is sized and shaped to facilitate repeated restrained engagement and disengagement with a restraining member of the female profile 24. The head 30 of the male profile 28 includes at least one sidewall 36 and sealant material 50. More particularly, the head 30 includes a channel 38 that contains the sealant material 50. The channel 38 is spaced from the sidewall 36 (e.g., a membrane) of the head 30 at such a distance so as to restrict the sealant material 50 from exiting the head 30 prior to engagement of the male profile 28 with the female profile 24. In the illustrated embodiment, the sealant material 50 is substantially sealed within (e.g., encapsulated within, completely enclosed within) channel 38 and thus is not capable of fluidly communicating with the exterior of the head 30 without an intervening rupturing force. In one embodiment, the force normally applied to facilitate such engagement may be such that a portion of the sidewall 36 proximal the channel 38 at least partially ruptures, thereby facilitating fluid communication between the gap 29 and the channel 38. Concomitant therewith, at least a portion of the sealant material 50 may flow out of the channel 38 into the gap 29 to seal such gap 29, thereby substantially restricting flow of fluids into and out of the resealable closure 20 via the gap 29.

The sidewall 36 generally comprises a polymeric material, and thus the sidewall 36 may be ruptured if its thickness is sufficiently thin, or a weakness is provided in, or proximal to, the sidewall. In the former approach, the distance between the sidewall 36 and the channel 38 may be such that the force normally applied during engagement of the male profile 28 with the female profile 24 results in rupturing of the sidewall 36, as described above. In other words, the thickness of the sidewall 36 is sufficiently thin so that, upon application of the normal force required to engage the male profile 28 with the female profile 24, the integrity of the sidewall 36 is compromised, thereby facilitating the fluid communication between the channel 38 and the gap 29. As may be appreciated, this thickness may be tailored in accordance with various design considerations, such as materials of use and size of the profile member(s), to name a few.

In another approach (not illustrated), the sidewall 36 or a surface proximal thereto may contain a weakness to facilitate rupturing of the sidewall 36 during engagement of the male profile 28 and the female profile 24. For example, the weakness may be a score, slit, notch, perforation or the like, which may be provided in the sidewall 36, or proximal thereto. Thus, when the male profile 28 engages the female profile 24, the weakness is compromised (e.g., broken), thereby rupturing at least a portion of the sidewall 36. In turn, the flow of sealant material 50 from the channel 38 into the gap 29 is enabled, thereby substantially sealing the gap 29. In some approaches, the weakness should allow rupturing of the sidewall, but prior to the rupturing event, should not allow fluid communication between the channel and the exterior of the containing profile prior to the rupturing. In one embodiment, the weakness contains one or more scores, slits, notches and/or perforations in an exterior surface of the profile containing the sealant material 50, but such scores, slits, notches and/or perforations do not fluidly communicate with the sealant material 50 and/or the channel 38. Thus, the sealant material 50 remains sealed within the profile member and with a weakness proximal thereto.

In another embodiment (not illustrated), passageways may be utilized to provide the sealant material 50 to the gap 29. In this embodiment, the profile member(s) (e.g., the male profile and/or female profile) containing the sealant material 50 may include one or more passageways, the passageways being in fluid communication with the gap 29 between the profile members and the sealant material. Thus, during engagement of the female and male profiles 24, 28, or thereafter, the sealant material 50 may flow from the channel 38, through the passageway(s) and into the gap 29.

The sidewall 36 may be integral with the profile member (s), or may be a separate component. In the later regard, the sidewall 36 may be bonded to the profile member(s). In one embodiment, the sidewall 36 comprises a first material (e.g., a membrane material) and the corresponding profile member (s) comprise a second material, different than the first material.

The volume of sealant material 50 contained within the female and/or male profiles 24, 28 should be sufficient to at least partially fill the gap 29 between the female profile 24 and male profile 28. For example, the channel 38 may contain a sufficient volume of sealant material 50 such that when the sidewall 36 ruptures, the volume of sealant material communicated to the gap 29 creates a continuum of sealant material between a surface of the male profile 28 and an opposing surface of the female profile 24, thereby filling space of the gap 29 and substantially restricting flow of gases and/or liquids therethrough.

Figure 5:
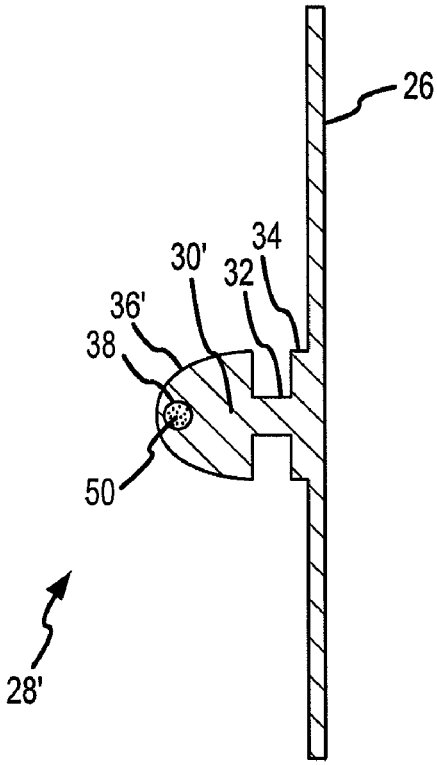
FIG. 5 is a cross-sectional, side view of one embodiment of a male profile.

As noted above, various resealable closures 20 are known in the art, and include various head configurations. In the embodiment illustrated in FIG. 4, the head 30 of the male profile 28 includes a triangular profile. However, many other male profile arrangements are known and may be utilized in accordance with the present invention. For example, and with reference to FIG. 5, a male profile 28' having a head 30' with a mushroom-like profile may be employed. In the illustrated embodiment, the male profile 28' includes a head 30' interconnected to a stem 32, which is interconnected to a base 34, which is interconnected to the second strip 26. The head 30' includes a sidewall 36' and a channel 38, which includes the sealant material 50. Many other head profiles and/or male/female arrangements may be used.

While male and female profiles have been used to describe embodiments of the present disclosure, complementary members that are not of the male-female type may also be employed, such as those disclosed in U.S. Patent Publication No. 2006/0048483 and U.S. Pat. Nos. 6,524,002; 6,152,600; 5,839,831; and 5,252,281, each of which is incorporated herein by reference in its entirety. The complementary member(s) containing the channel and the sealant material should have the channel spaced from a sidewall at such a distance so as to facilitate rupture of the sidewall upon engagement of the complementary members and/or should include a weakness in or proximal to the sidewall.

Figure 6:
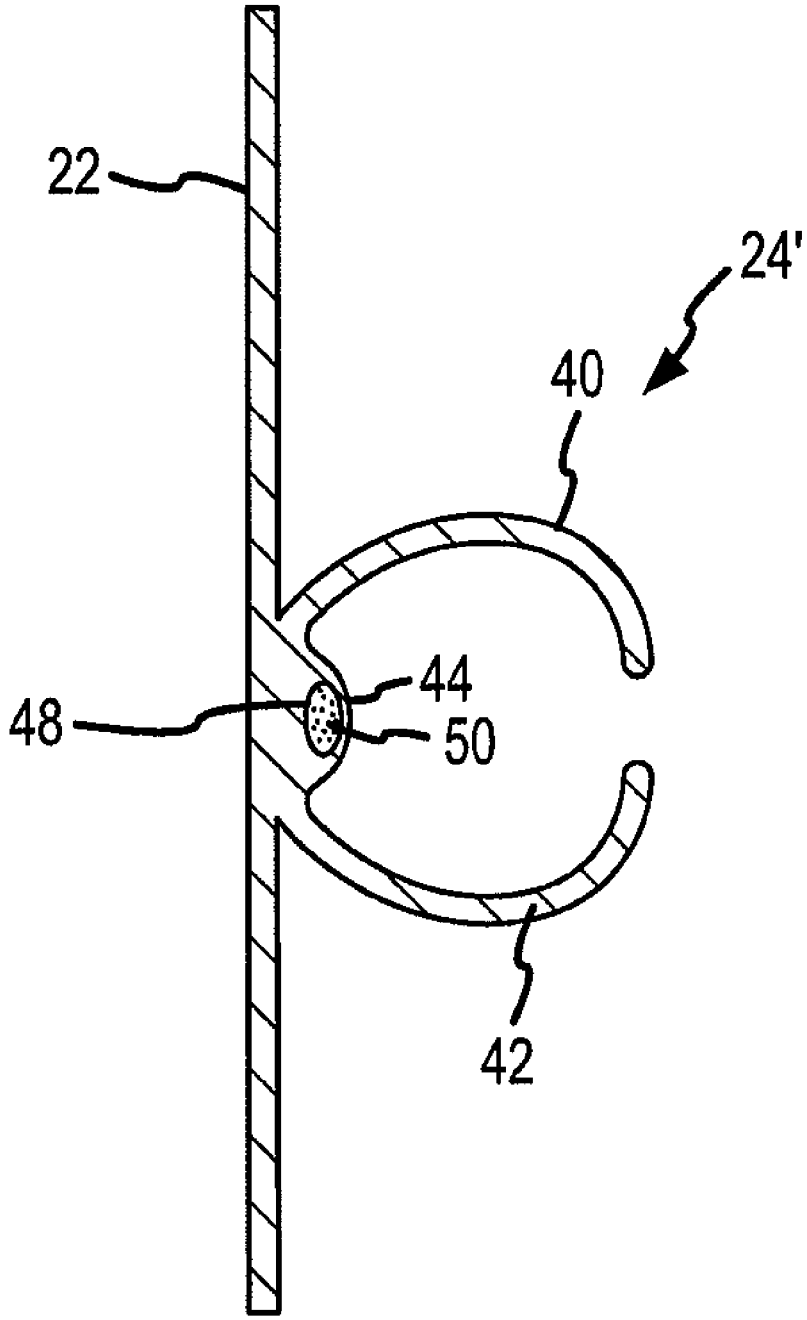
FIG. 6 is a cross-sectional side view of one embodiment of a female profile.

As noted above, the sealant material 50 may be contained in one or more of the female profile 24 and/or the male profile 28. In some embodiments, the sealant material is sealed within both the female profile 24 and the male profile 28. Some embodiments of male profiles including the sealant material 50 have been described above. One embodiment of a female profile 24 including the sealant material 50 is illustrated in FIG. 6. In the illustrated embodiment, a female profile 24' includes a restraining member, such as a first arm 40 and a second arm 42. The first arm 40 and second arm 42 are interconnected to the first strip 22. The female profile 24' further includes a bump 44 protruding from the surface of the first strip 22. The bump 44 is also interconnected with the first arm 40 and second arm 42 of the female profile 24'. The bump 44 includes a channel 48, which contains the sealant material 50 and is fully enclosed within the bump 44. Similar to described above, as the male profile 28 engages female profile 24', the head 30 of the male profile 28 may exert force on bump 44, thereby rupturing a sidewall of the bump 44, thereby facilitating fluid communication between the channel 48 and the gap 29 between the male profile 28 and the female profile 24'. In turn, flow of sealant material 50 from the channel 48 into the gap 29 is enabled, thereby substantially sealing gap 29.

The sealant material 50 may comprise any suitable sealing material. The sealant material 50 may be a viscous fluid, a fluid-like substance, and the like. In one embodiment, the sealant material 50 comprises a density that is less than the density of the male and/or female profiles 28, 24. In one embodiment, the sealant material is suitable for at least incidental contact to food items passed through the opening 17 through the interior space 19 of the polymeric package 10. The term "suitable" for at least incidental contact denotes compounds that are eligible for compliance with one or equivalent to being in compliance with the Federal Food, Drug, and Cosmetic Act (Title 21 of the Code of Federal Regulations) standards for being generally recognized as safe (GRAS). The term "at least incidental contact" includes at least an unanticipated contact of food items being passed through the opening 17 on which the resealable closure 20 is positioned as the food items are being inserted into the interior space 19 of the polymeric package 10. Although indirect contacts between the sealant material 50 and the food items is preferred, in some embodiments the sealant material 50 may more directly contact the food, so long as the interaction between the food items and the sealant material 50 is in accordance with the regulations of the Federal Food, Drug, and Cosmetic Act.

In one embodiment, the sealant material 50 is a lubricant, such as any of the lubricants defined in Title 21 of the U.S. Federal Code of Federal Regulations, Section 178.3570, revised as of Apr. 1, 2003, and so long as those lubricants are consistent with the Federal Food, Drug, and Cosmetic Act and have an operable temperature range suitable for food storage and packaging. In one embodiment, the sealant material 50 maintains its chemical structure throughout the operable temperature ranges of the polymeric package 10. Generally, the operable temperature range of the polymeric package 10 is defined as the temperature range that the polymeric package 10 is typically subjected to in shipping, packaging and food storage applications, for example, food storage applications ranging from approximately −10° F. to approximately 160° F. One example of such a lubricant is a silicone-based lubricant such as dimethylpolysiloxane. Another example is soy-based oils, for example, those distributed by Cargill Corp., and soy-based additives, for example, those distributed by DuPont™ as Pro-Cote® soy polymers. Yet other examples include waxes, fatty acids, oils and other hydrocarbon-based oils, gels and the like. Such sealant materials should be in compliance with the Federal Food, Drug, and Cosmetic Act for food storage applications.

In one embodiment, the sealant material 50 is a caulking composition. The caulking composition may comprise any material that provides a selectively reversible substantially air-tight seal between the female and male profiles 24, 28 of the resealable closure 20, in which the caulking composition is suitable for at least incidental contact to food items inserted through the opening to the storage space. Preferably, the caulking composition maintains its chemical structure throughout the operable temperature range of storage device 10.

In order to provide a substantially air-tight seal, in some embodiments the sealant material 50 should be selected to have a work penetration of about 290 to about 340, in which the work penetration is measured at 60 strokes and a temperature of 77° F. in accordance with the National Lubricating Grease Institute (NLGI) system for rating greases by penetration and ASTM D217-97 titled "Standard Test Methods for Cone Penetration of Lubricating Grease" (1997). The NLGI classifies greases by consistency numbers as measured by worked penetration. In one embodiment, the sealant material 50 has a work penetration on the order of about 290 to about 340 and is classified as a grease having a NLGI consistency number equal to approximately 2. In other embodiments, the sealant material 50 has an NLGI consistency number higher or lower than approximately 2, so long as the sealant material 50 may flow to seal gaps 29 between the female and male profiles 24, 28 of the resealable closure 20 and the sealant material 50 is contained within the resealable closure 20 when exposed to temperatures consistent with food storage container applications. In one embodiment, the sealant material 50 has a low enough viscosity so as to facilitate flow of the sealant material 50 into the gaps upon rupturing of the channel and/or upon application of forced applied to close the resealable closure 20. In one embodiment, the sealant material 50 has a sufficiently high viscosity so that it does not freely flow out of the resealable closure 20. In some embodiments, the sealant material comprises properties (e.g., surface tension) that enables at least some of the sealant material 50 to flow into the gaps 29 via capillary action.

One example of a sealant material 50 that meets at least some of the above requirements is silicone grease. Silicone grease is an amorphous, filmed silica thickened, polysiloxane-based compound. Silicone grease is formed by combining liquid silicone with an inert silica filler. One example of liquid silicone that may be utilized in forming silicone grease having suitable work penetration properties is polydimethylsiloxane having a specific gravity on the order of about 0.973 and a viscosity greater than about 300 centistokes, preferably on the order of about 350 centistokes. Fumed silica, an inert silica filler, has a chain-like particle morphology and when incorporated into liquid silicone forms three dimensional networks that trap the liquid and effectively increases the liquid's viscosity.

Silicone grease may provide desired work penetration values within the likely temperature range to produce an adequately air-tight seal by selecting the proper proportions of inert silica filler to liquid silicone. The proportion of inert silica filler to liquid silicone is generally selected to ensure that separation of liquid from solid in the silicone grease is substantially eliminated throughout the operable temperature range of the bag as applied to food container storage. In general, proportions of inert silica filler to liquid silicone are selected to yield a silicone grease viscosity that does not substantially inhibit the flow of silicone grease into the gaps 29 of the resealable closure 20. The proportion of inert silica filler to liquid silicone is generally less than approximately 30% by weight. For example, the proportion of inert silica filler to liquid silicone may be about 6% by weight.

One useful silicone grease is Clearco™ Silicone Grease (food grade) manufactured by Clearco Products Co., Inc., Bensalem Pa. Clearco™ Silicone Grease (food grade) has a work penetration value of about 290 to about 340, in which the work penetration is measured at 60 strokes and a temperature of 77° F. Clearco™ Silicone Grease (food grade) comprises 94% dimethylpolysiloxane and 6% fumed silica by weight % and has a specific gravity on the order of about 1.1. Clearco™ Silicone Grease may be utilized at temperatures ranging from approximately −40° F. to approximately 400° F. without chemical decomposition and is therefore well suited for food storage applications.

Figure 7A:
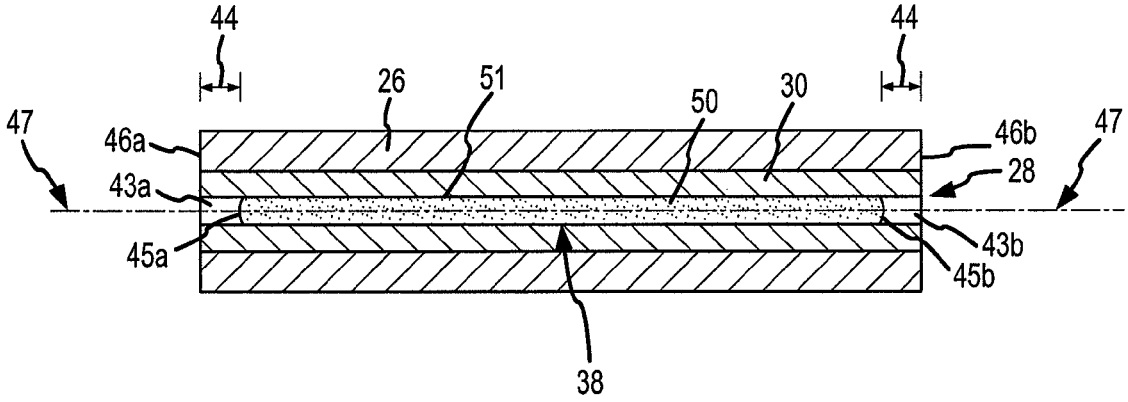
FIG. 7*a* is a perspective view of one embodiment of a resealable closure.

As described above, the sealant material 50 is generally sealed within at least one of the female profile 24 and/or male profile 28. As discussed in further detail below, the sealant material 50 may be sealed within the male profile 28 and/or the female profile 24 via co-extrusion of the materials. Thus, the channels 38 and/or sealant material 50 may extend along an axis of the female profile 24 and/or the male profile 28. One example of an embodiment including a sealant material sealed coincidental to an axis of a male profile 28 is illustrated in FIG. 7*a*. In the illustrated embodiment, the male profile 28 includes a head 30 extending along an axis 47 of the second strip 26. The channel 38 also extends along the axis 47 of the second strip 26. At least some of the channel 38 includes sealant material 50 sealed therein. Thus, the sealant material 50 and channel 38 extend coaxially in the illustrated embodiment within the head 30 of the male profile 28. In other embodiments, the channel 38 and/or sealant material 50 need not be coincidental to the axis 47 of the second strip 26.

In the illustrated embodiment, the channel 38 is only partially full of the sealant material 50. Such a configuration may facilitate production of the polymeric package 10. More particularly, during formation of the polymeric package 10, the first and second sides 12, 14 may be produced via heat sealing. As may be appreciated, such heat sealing may require sealing of the polymeric package 10 along a portion that includes the resealable closure 20. If the resealable closure 20 contains sealant material at the locations at which the first and second sides 12, 14 are formed, it may be difficult to heat seal those portions as the sealant material 50 may undermine the bonding between the first panel 11 and the second panel 13. Thus, it may be desirable to include spaced portions within the channel 38 that do not include sealant material 50. More particularly, and with continued reference to FIG. 7*a*, the channel 38 may include void portions 43*a*, 43*b* that do not include any substantial amount of sealant material 50. In the illustrated embodiment, the channel 38 includes a first void portion 43*a* and a second void portion 43*b*. The channel 38 also includes a sealant containing portion 51, at least partially defined by sealant ends 45*a*, 45*b*, that includes sealant material 50. The second strip 26 may be aligned with the second panel 13 of the polymeric package 10 so that the void portions 43*a*, 43*b* may correspond with the portions to be heat sealed to define first side 12 and second side 14, respectively. Thereafter, the first panel 11 may be bonded to the second panel 13. The second strip 26 may include a first side 46*a*, which is associated with where the first side 12 of the polymeric package 10 may be formed. Correspondingly, the second strip 26 may include a second side 46*b*, which is associated with where the second side 14 of the polymeric package 10 may be formed. The distance 44 between the sides 46*a*, 46*b* of the first strip 22 and the sealant ends 45*a*, 45*b* of the channel 38 may be any distance suitable to facilitate formation of the sides 12 and 14 via an adhesive and/or heat sealing. As discussed in further detail below, the sealant containing portion 51 and the void portions 43*a*, 43*b* may be formed by intermittently stopping the injection of sealant material into the male profile 28 during the co-extrusion process, as described below.

Figure 7B:
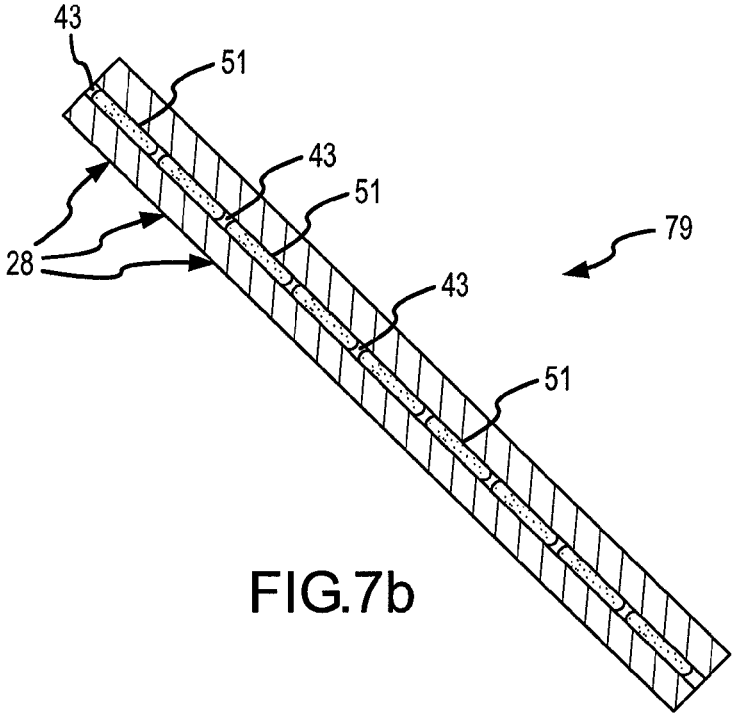
FIG. 7*b* is a perspective view of a strip containing a plurality of the resealable closures of FIG. 7*a*.

As may be appreciated, the intermittent sealant technique of FIG. 7*a* may be utilized with a single resealable closure, or may be utilized with a plurality of resealable closures. For example, and with reference to FIG. 7*b*, a strip 29 adapted to produce a plurality of resealable closures, each including a male profile 28, is provided. The strip 29 may be interconnected with a polymeric sheet to form a plurality of polymeric packages. The strip 29 includes a plurality of sealant containing portions 51 and void portions 43 so as to facilitate bonding between first and second panels 11,13, as described above.

Figure 8A:
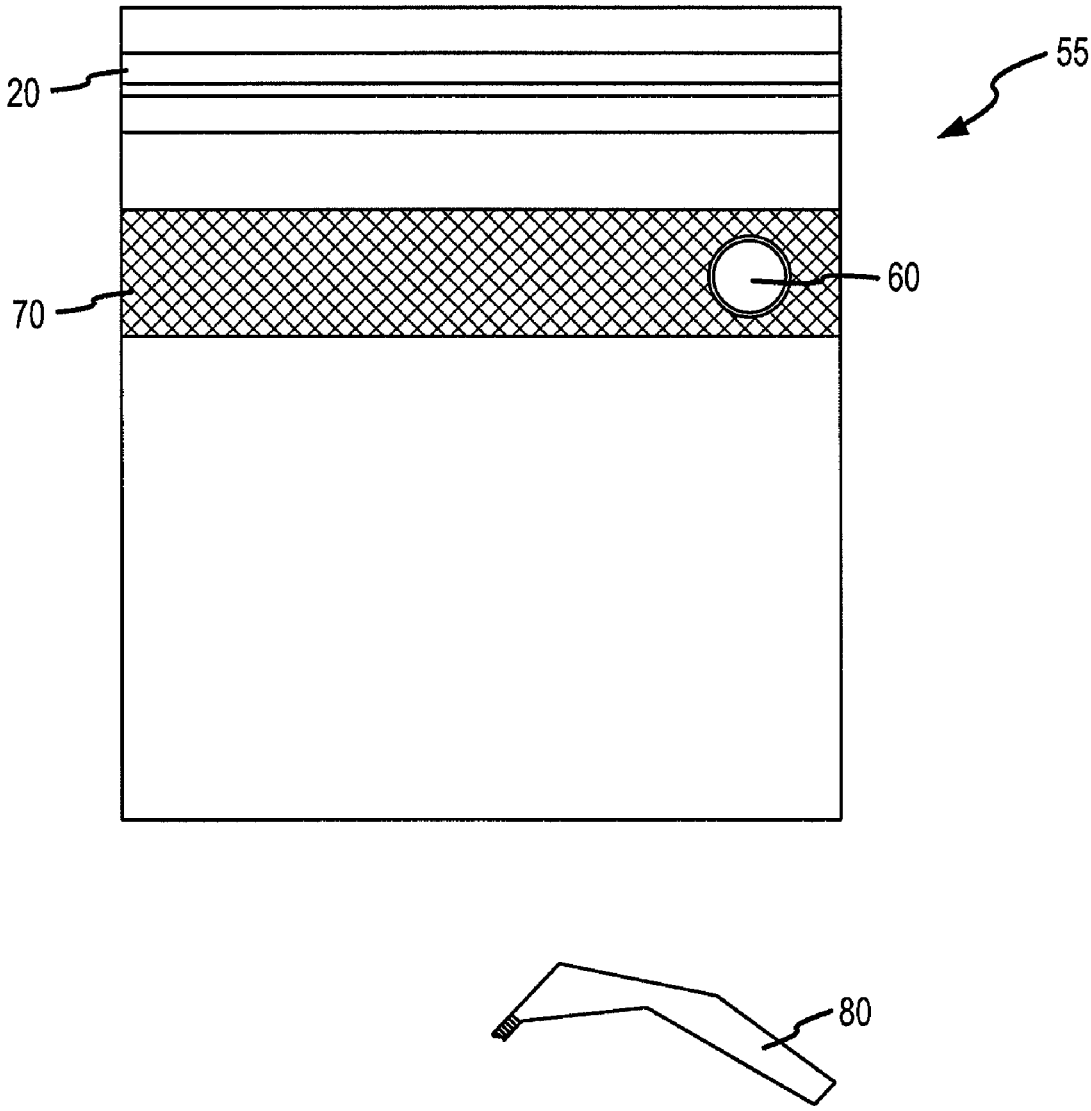
FIG. 8*a* is a perspective view of an embodiment of a system including a resealable closure.

The resealable closure 20 may be utilized with any suitable polymeric package 10. In one embodiment, the resealable closure 20 is utilized with a polymeric package adapted to facilitate removal of gases and/or liquids therefrom. More particularly, and with reference to FIG. 8*a*, an evacuable package 55 adapted for removal of fluids therefrom may be utilized with the resealable closure 20. In the illustrated embodiment, the evacuable package 55 includes the resealable closure 20. The evacuable package 55 also includes a vacuum valve 60 and a stand-off structure 70. Such vacuum valves 60, polymeric packages 55 and/or stand-off structures 70 are described in PCT Publication No. WO2006/012528, which is incorporated herein by reference in its entirety.

The vacuum valve 60 may be any of the vacuum valves disclosed in PCT Publication No. WO2006/012528. Generally, the vacuum valve 60 is in fluid communication with the interior space 19 of the evacuable package 55 and defines a sealable passage through which liquids and/or gases may be drawn. The vacuum valve 60 is often a one-way evacuation valve, allowing fluid flow therethrough in only one-direction; generally, the direction is from the interior space 19 of the evacuable package 55 to the exterior of evacuable package 55.

Figure 8B:
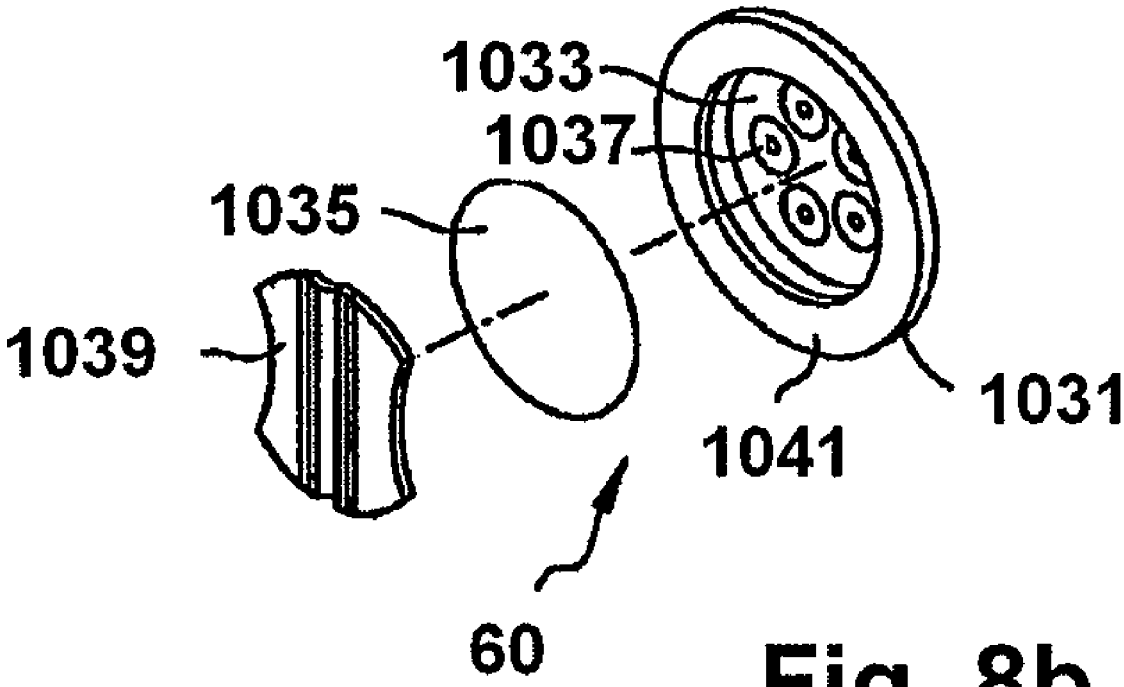
FIG. 8*b* is an exploded view of a vacuum valve.

Referring to FIG. 8*b*, in one embodiment the vacuum valve 60 includes a base 1031 having a flat surface 1033 with at least one opening 1037 therethrough, a resilient valve element 1035, and an alignment device 1039. The base 1031 is sealingly engaged to the evacuable package 55. The valve element 1035 is generally flat and disposed adjacent to the flat surface 1033. The alignment device 1039 is coupled to the base 1031 and is structured to bias the valve element 1035 against the flat surface 1033. The valve element 1035 is structured to move between a first position, where the opening 1037 is open, and a second position, where the opening 1037 is sealed. The valve element 1035 is normally biased to the second position. The base 1031 has a defined shape, such as, but not limited to a concave disk. The outer surface 1041 of the base 1031 is a generally flat torus.

The vacuum valve 60 can be any suitable valve assembly, including those known as "Goglio" type or "Raackmann" type. Goglio-type valves are available, for example, from Bosch, Wipf, and Wico; Raackmann-type valves are available, for example, from Amcor. Other examples of suitable vacuum valves 30 include those described in U.S. Pat. Nos. 6,913,803; 6,733,803; 6,607,764; and 6,539,691, each of which is incorporated herein by reference in its entirety. In one embodiment of the present invention, the vacuum valve 60 may be consistent with the valves disclosed in U.S. Patent Application Publication 11/100,301, entitled "EVACUATABLE CONTAINER", filed Apr. 6, 2005. It is noted that the sealing nature of the valve element 1035 may be enhanced by incorporating a sealing material into the sealing members of the valve assembly. In another embodiment, the vacuum valve 60 may further include at least one rib (not depicted) extending from the interior side of the valve assembly base 1031, wherein the rib extending from the base 1031 ensures that the valve assembly is not obstructed during application of the vacuum.

Figure 8C:
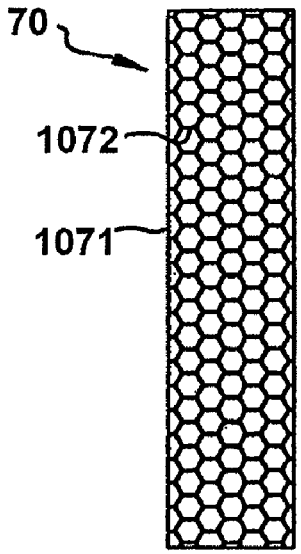
FIG. 8*c* is a front view of one embodiment of a stand-off structure.
Figure 8D:
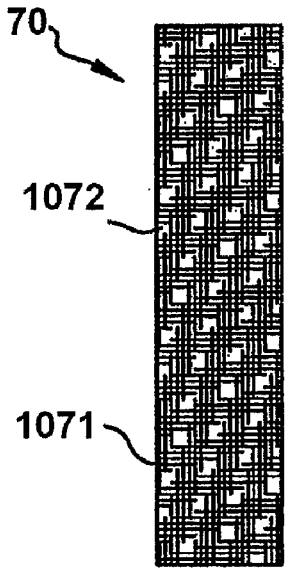
FIG. 8*d* is a front view of one embodiment of a stand-off structure.
Figure 8E:
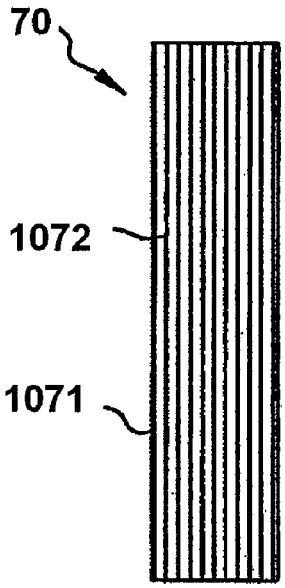
FIG. 8*e* is a front view of one embodiment of a stand-off structure.
Figure 8F:
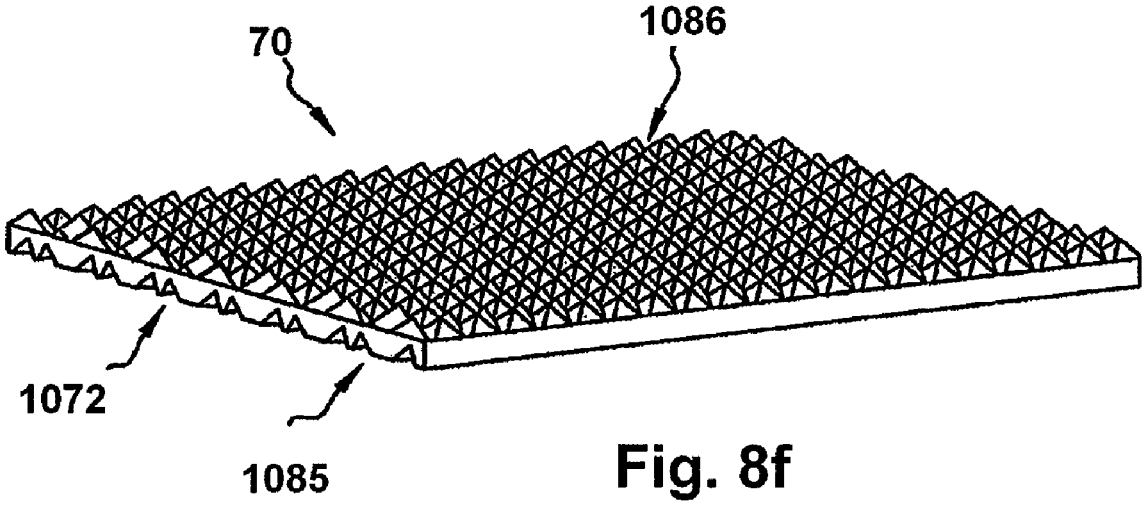
FIG. 8*f* is an isometric view of one embodiment of a stand-off structure.

The stand-off structures 70 may be any of the stand-off structures described in PCT Publication No. WO2006/012528. The stand-off structure 70 provides a communicating passage for the removal of liquids and gases from the evacuable package 55. For example, and with reference to FIGS. 8*c*-8*p*, in one embodiment, a strip 1071 of film having a pattern of channels 1072 embossed, or cut, therein may be utilized. The stand-off structure channels 1072 are designed not to collapse even when the evacuable package 55 is placed under a vacuum. The channels 1072 may be in any shape, such as, but not limited to a honeycomb pattern (FIG. 8*c*), a grid or partial grid (FIG. 8*d*), a series of parallel grooves (FIG. 8*e*) or a series of triangular columns (FIG. 8*f*). In one embodiment, and with reference to FIG. 8*g*, a cavity face 1085 of the stand-off structure 70 faces the vacuum valve 60 and a protrusion face 1086 of the stand-off structure 70 faces the interior space 19.

Figure 8G:
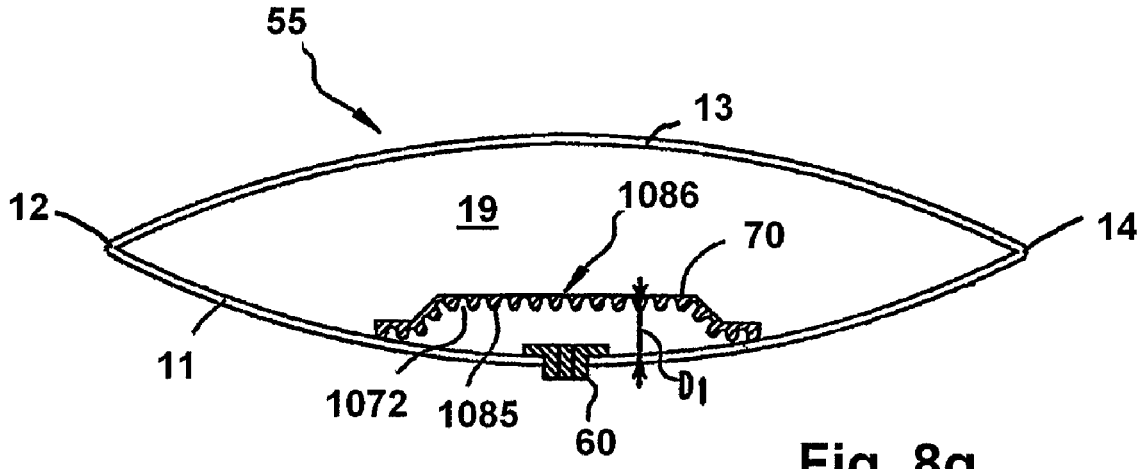
FIG. 8*g* is a cross-sectional view of the storage device depicted in FIG. 8*l* along section line 8*g*.
Figure 8H:
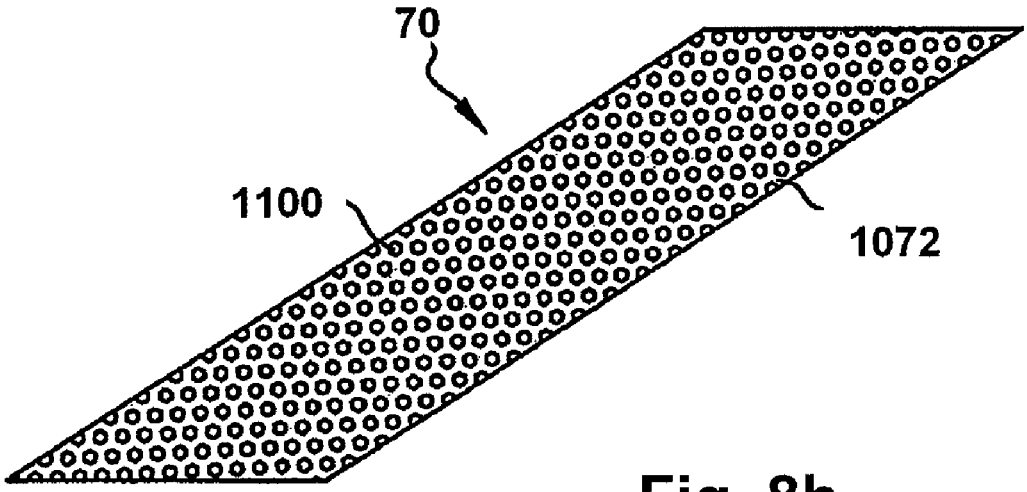
FIG. 8*h* is an isometric view of one embodiment of a stand-off structure.
Figure 8I:
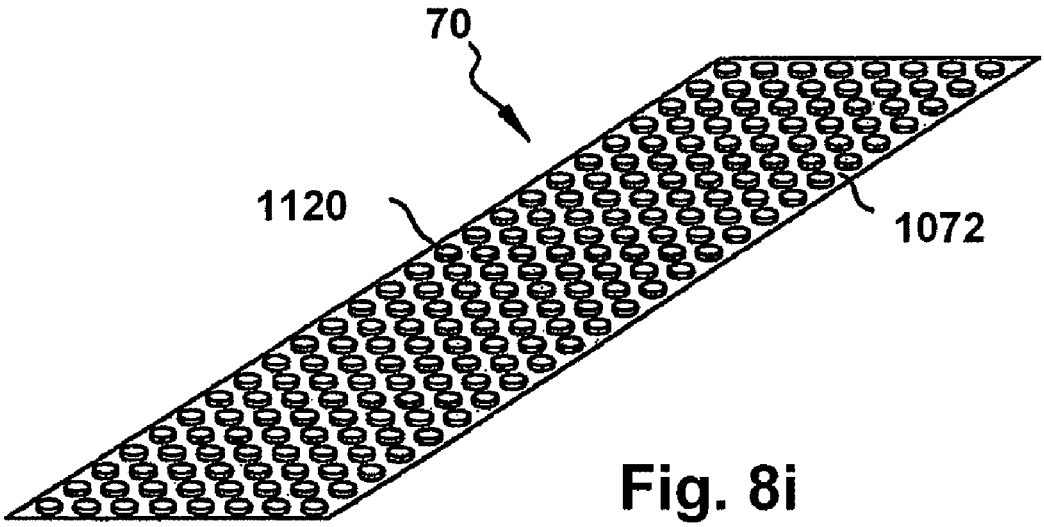
FIG. 8*i* is an isometric view of one embodiment of a stand-off structure.

The honeycomb pattern of channels is depicted in an isometric view in FIG. 8*h*, in which the channels 72 that provide the communicating passage for the removal of liquids and gases is defined by a series of polyhedron structures 1100. Referring now to FIG. 8*i*, in another embodiment of the stand-off structure 70, the pattern of channels 1072 for the removal of liquids and gasses may be provided by a series of curvilinear columns 1120.

Regardless of the geometry selected for providing the channels 1072, the stand-off structure 70 generally facilitates a passage for the removal of liquids and gases by providing a cross-section with a series of raised surfaces and recessed surfaces. In one embodiment, the stand-off structure 70 is integral with a fluid conduit providing fluid communication between the interior space 19 of the evacuable package 55 and a vacuum pump 80, by which the storage device is evacuated.

Figure 8J:
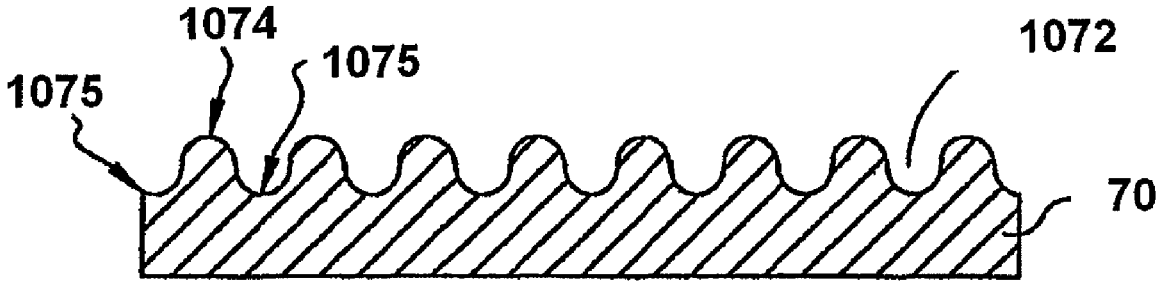
FIG. 8*j* is a cross-sectional view of one embodiment of a stand-off structure.
Figure 8K:
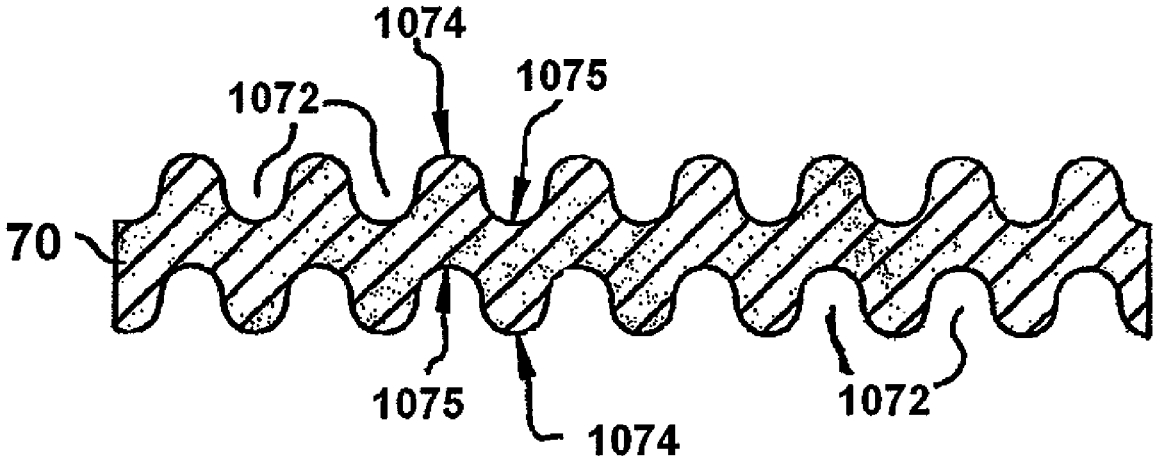
FIG. 8*k* is a cross-sectional view of one embodiment of a stand-off structure.

Referring to FIG. 8*j*, channels 1072 are provided in the area defined between the raised surfaces 1074 and recessed surfaces 1075 of the stand-off structure's 70 cross-section. The stand-off structure 70 may have a series of channels 1072 on one side of the stand-off structure 70, as depicted in FIG. 8*j*, or on both sides of the stand-off structure 70, as depicted in FIG. 8*k*.

Referring back to FIG. 8*f*, in one embodiment of the present invention, the cavity face 85 of the stand-off structure 70 comprises channels 1072 and the protrusion side 1086 comprises a series of communicating passages produced by a plurality of polyhedron structures.

Figure 8L:
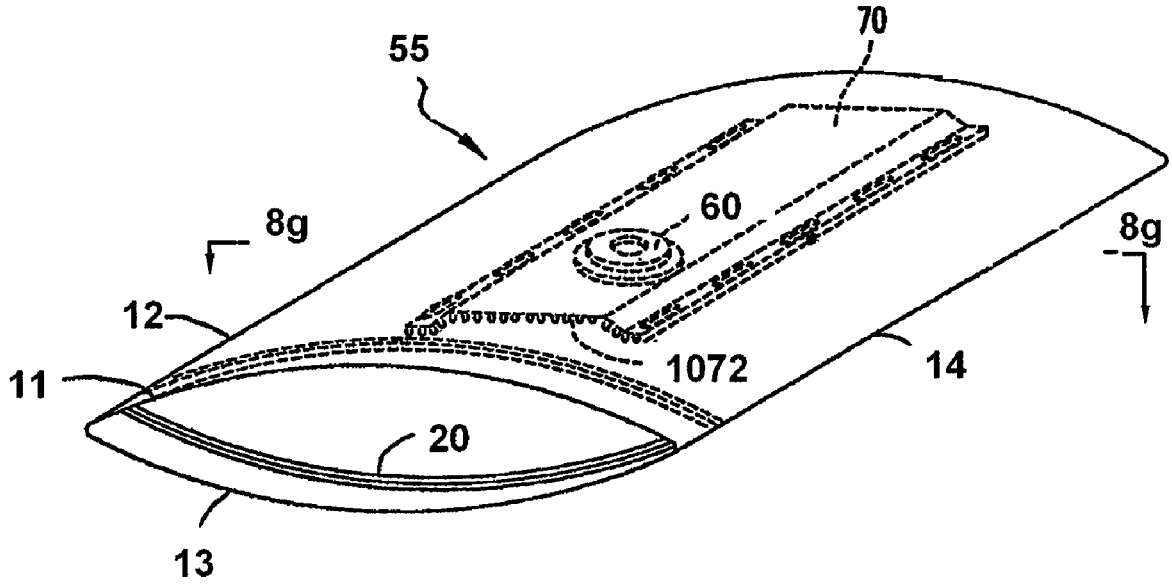
FIG. 8*l* is an isometric view of an evacuable package in a folded condition.
Figure 8M:
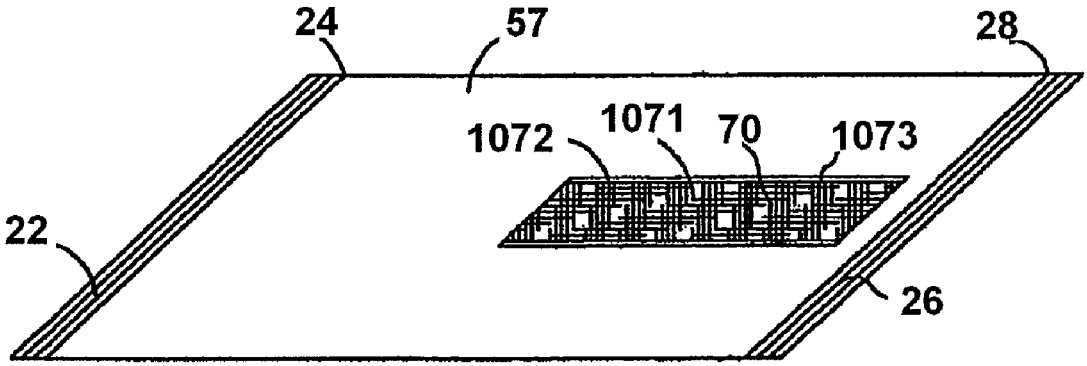
FIG. 8*m* is an isometric view of one embodiment of interconnection of a stand-off structure to a plastic material.
Figure 8N:
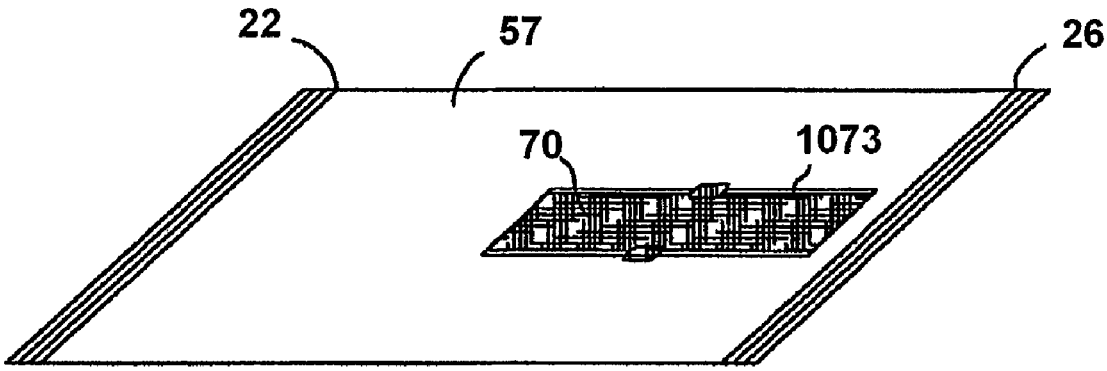
FIG. 8*n* is an isometric view of one embodiment of interconnection of a stand-off structure to a plastic material.
Figure 8O:
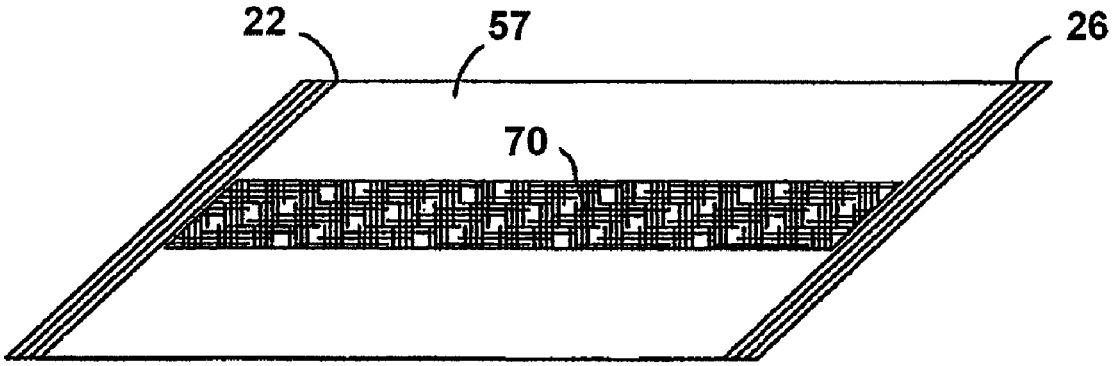
FIG. 8*o* is an isometric view of one embodiment of interconnection of a stand-off structure to a plastic material.
Figure 8P:
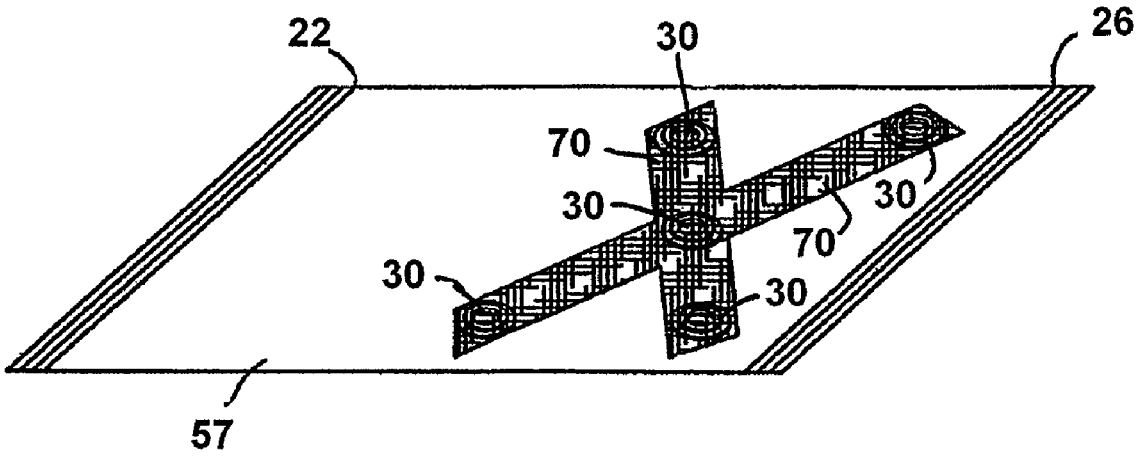
FIG. 8*p* is an isometric view of one embodiment of interconnection of a stand-off structure to a plastic material.

As shown in FIGS. 8*g*, 8*l*, and 8*m*-8*p*, the stand-off structure 70 may be bonded to the inner side of the evacuable package 55, on the same side of the evacuable package 55 as the vacuum valve 60. The stand-off structure 70 may be thermally bonded to the evacuable package 55, or any other conventional bonding method may be utilized to interconnect the stand-off structure 70 to the evacuable package 55. The stand-off structure 70 may be positioned at a location associated with the location of the vacuum valve 60. Multiple valve assemblies 60 and multiple stand-off structures 70 may be utilized in a single evacuable package 55, as depicted in FIG. 8*p*.

As shown in FIG. 8*m*, the stand-off structure 70 may be coupled to the evacuable package 55 prior to forming the evacuable package 55. For example, an entire side periphery 1073 of the stand-off structure 70 may be bound to a plastic sheet 57 that forms at least a portion of the evacuable package 55. Referring to FIG. 8*n*, in another embodiment, the stand-off structure 70 may be coupled to the evacuable package 55 by bonding only selected portions of the stand-off's side periphery 73 to the plastic sheet 57. Additionally, and as shown in FIG. 8*o*, as opposed to limiting the stand-off structure 70 to a single side of the evacuable package 55, the stand-off structure 70 may be coupled to extend across the plastic sheet 57, so as to provide a stand-off structure 70 on both sides of the evacuable package 55, such as when the plastic sheet 57 is folded over to form the evacuable package 55. In another example, the stand-off structure 70 may be positioned to extend diagonally across the plastic sheet as depicted in FIG. 8*p*. It is noted that examples depicted in FIGS. 8*a*-8*p* have been provided for illustrative purposes and that other configurations of the stand-off 70 are within the scope of the present invention, so long as the stand-off 70 is positioned to be in fluid communication with the vacuum valve 60 in a manner that allows for the removal of liquids and gasses from the evacuable package 55.

FIG. 8*l* depicts the positioning of the stand-off structure 70 once the plastic sheet 57 is folded over upon itself and two sides 12, 14 are sealed adjacent to the periphery forming the interior space 19. In the illustrated embodiment, the stand-off structure 70 is depicted as being bound to the face of the plastic sheet 57 within the storage space 19, wherein the channels 1072 of the stand-off structure 70 face the surface of the plastic sheet 57 to which the stand-off structure 70 is bound. In an alternate embodiment, the stand-off structure 70 may include channels 1072 on both sides of the stand-off structure 70 (e.g., as with the embodiment of FIG. 8*k*), in which the channels on a first side of the stand-off structure 70 face the surface of the plastic sheet 57 to which the stand-off structure 70 is bound and the channels 1072 on the second side of the stand-off structure 70 face the opposing plastic sheet.

FIG. 8*g* illustrates the cross-section of the storage device 10 depicted in FIG. 8*l* along reference line 8*g*, in which the channels 1072 of the stand-off structure 70 are depicted as facing away from the storage space 19 and towards the vacuum valve 60 as well as the surface of the plastic sheet 57 to which the stand-off structure 70 is bound. Prior to the application of a vacuum, the portion of the stand-off structure 70 opposing the vacuum valve 60 may be separated from the vacuum valve 60 by a distance D1, which can range from about 0.003" to about 0.25".

Referring back to FIG. 8*a*, the resealable closure 20 may facilitate evacuation of evacuable package 55 by providing a substantially air-tight seal. In this regard, a vacuum pump 80 may be utilized in conjunction with the vacuum valve 60 to evacuate fluids therefrom, thereby creating vacuum within an evacuable package 55, as described in PCT Publication No. WO2006/012528. The vacuum pump 80 may be any of the pumps described in PCT Publication No. WO2006/012528. The sealant material 50 of the resealable closure 20 facilitates maintenance of the vacuum within the evacuable package 55 by restricting, and in some instance preventing, fluid communication from the interior space of the evacuable package 55 and exterior of the evacuable package 55 via the resealable closure 20.

In one application, the vacuum pump 80 is attached to the vacuum valve 30, which is in fluid communication with at least one stand-off structure 70. The vacuum pump 80 is operated, applying a vacuum to the interior of the evacuable package 55 via the vacuum valve 60 and the stand-off structure 70, causing the interior space 19 to collapse upon an article contained therein (e.g., a food article or other article suitable for storage within the evacuable package 55). During the application of the vacuum, the stand-off structure 70 separates the article from the vacuum valve 60, thereby restricting the article from obstructing the flow of gases (e.g., air) and/or liquids to be removed from the evacuable package 55, and insuring that the walls of the storage device conform tightly to the food article. Concomitantly, the sealant material 50 restricts flow of gases and liquids into and out of the evacuable package 55, thereby facilitating maintenance of a vacuum within evacuable package 55. Additionally, as the vacuum causes the evacuable package 55 to collapse, the raised portions of the stand-off structure 70 facilitate removal of at least a portion of the remaining gases and/or liquids. During the application of the vacuum, the distance D1 separating the vacuum valve assembly 30 from the opposing raised surfaces of the stand-off structure 70 may be substantially eliminated while maintaining an effective passageway for removing at least a portion of the remaining gases and liquids from the evacuable package via the stand-off structure 70.

The polymeric package 10 and/or the evacuable package 55 may be produced via any suitable processes. For example, the packages 10, 55 may be made by a horizontal process (e.g., where flexible material(s) forming side panels 11, 13, and resealable closure 20 move in a generally horizontal direction), a vertical process (e.g., where flexible material(s) forming side panels 11, 13, and resealable closure 20 move in a generally vertical direction), and combinations thereof.

In one general embodiment of a horizontal process, two extended lengths of the flexible material, each forming a side panel 11, 13 move in a generally horizontal direction. An extended length of resealable closure 20 may be attached to side panels 11, 13. Concomitant to this attaching, the resealable closure 20 may form a substantially air-tight closure, such as when sufficient force is applied to rupture a sidewall proximal a channel containing sealant material (e.g., during interconnection of the male profile and the female profile).

With respect to an evacuable package 55, a stand-off structure 70 can be attached to one or more of the side panels 11, 13, or can be integral with side panels 11, 13, or can be side panels 11, 13. A vacuum valve 60, and an optional corresponding hole, is/are typically installed into/produced in one of the extended lengths of flexible material at predetermined intervals, to correspond to one vacuum valve 60 per evacuable package 55. After the various elements have been joined to form an extended length, seals, which will result in sides 12, 14 and bottom edge 16, are made. Lateral seal portions (not illustrated) which are seals located proximal the overlap of the sides 12, 14 and the resealable closure 20, are usually made (e.g., crushed) simultaneously with the sides 15, but could be made in a separate step.

In an alternate embodiment of a horizontal process, one extended length of flexible material moves in a generally horizontal direction. This flexible material is folded to form both side panels 11, 13 and bottom edge 16. Any order of applying the resealable closure 20, the stand-off structure 70 and the vacuum valve 30 may be employed. Similar to the above embodiment, after the various elements have been joined to form an extended length, the sides 12, 16 may be made (e.g., via heat sealing).

In one embodiment of a vertical process, two extended lengths of flexible material, each forming a side panel 11, 13 move in a generally vertical downward direction. Similar to above, an extended length of resealable closure 20 may be attached to the side panels 11, 13, before, after, or concurrently with the bottom 16 being sealed, and a substantially air-tight resealable closure 20 may be formed. With respect to an evacuable package 55, a stand-off structure 70 can be attached to one or more of the side panels 11, 13, or can be side panels 17, 19. A vacuum valve 30, and an option corresponding hole, is/are typically installed into/produced in one of the extended lengths of flexible material at predetermined intervals, to correspond to one vacuum valve 30 per evacuable package 55. After the various elements have been joined to form an extended length, seals, which will result in sides 12, 14, are made.

In an alternate embodiment of a vertical process, one extended length of flexible material moves in a generally vertical direction. This flexible material is folded to form both side panels 11, 13 and bottom edge 16. Any order of applying the resealable closure 20, the stand-off structure 70 and the vacuum valve 30 may be employed. Similar to the above embodiment, after the various elements have been joined to form an extended length, the sides 15 12, 14 may be made.

Figure 9A:
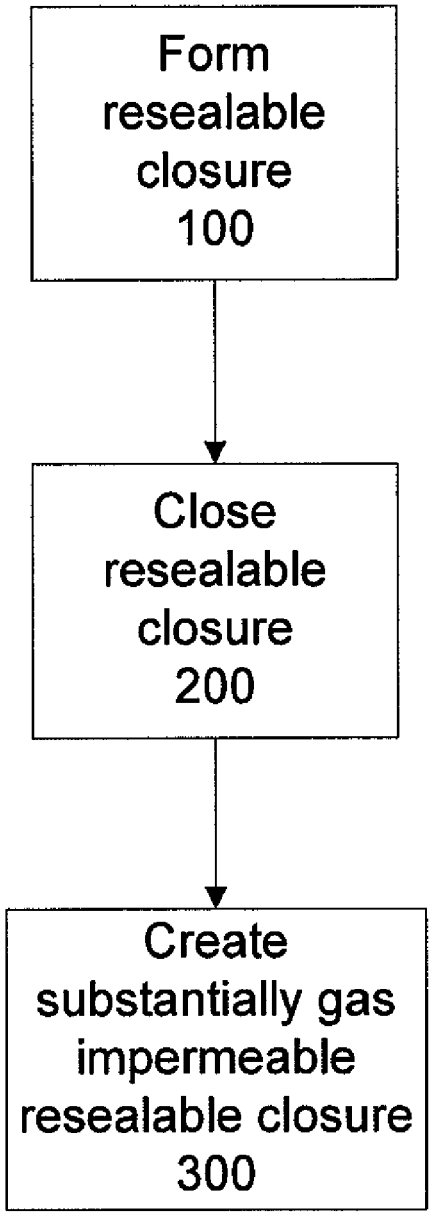
FIG. 9*a* is a block diagram illustrating one method for forming a resealable closure.

Methods for forming resealable closures and creating polymeric packages that include such resealable closures are also provided. One embodiment of a method for creating a substantially gas-impermeable resealable closure is illustrated in FIG. 9*a*. In the illustrated embodiment, the method includes the steps of forming a resealable closure 100, at least partially closing the resealable closure 200, and creating a substantially gas-impermeable resealable closure 300. The resealable closure may be any of the above-described resealable closures that contain a sealant material sealed within at least one of the male profile and/or female profile. Thus, as the resealable closure is closed, or concomitant thereto, the sealant material may be provided to a gap between the male profile and female profile, thereby creating a substantially gas-impermeable seal within the resealable closure (e.g., via restriction of fluid flow through the gap).

Figure 9B:
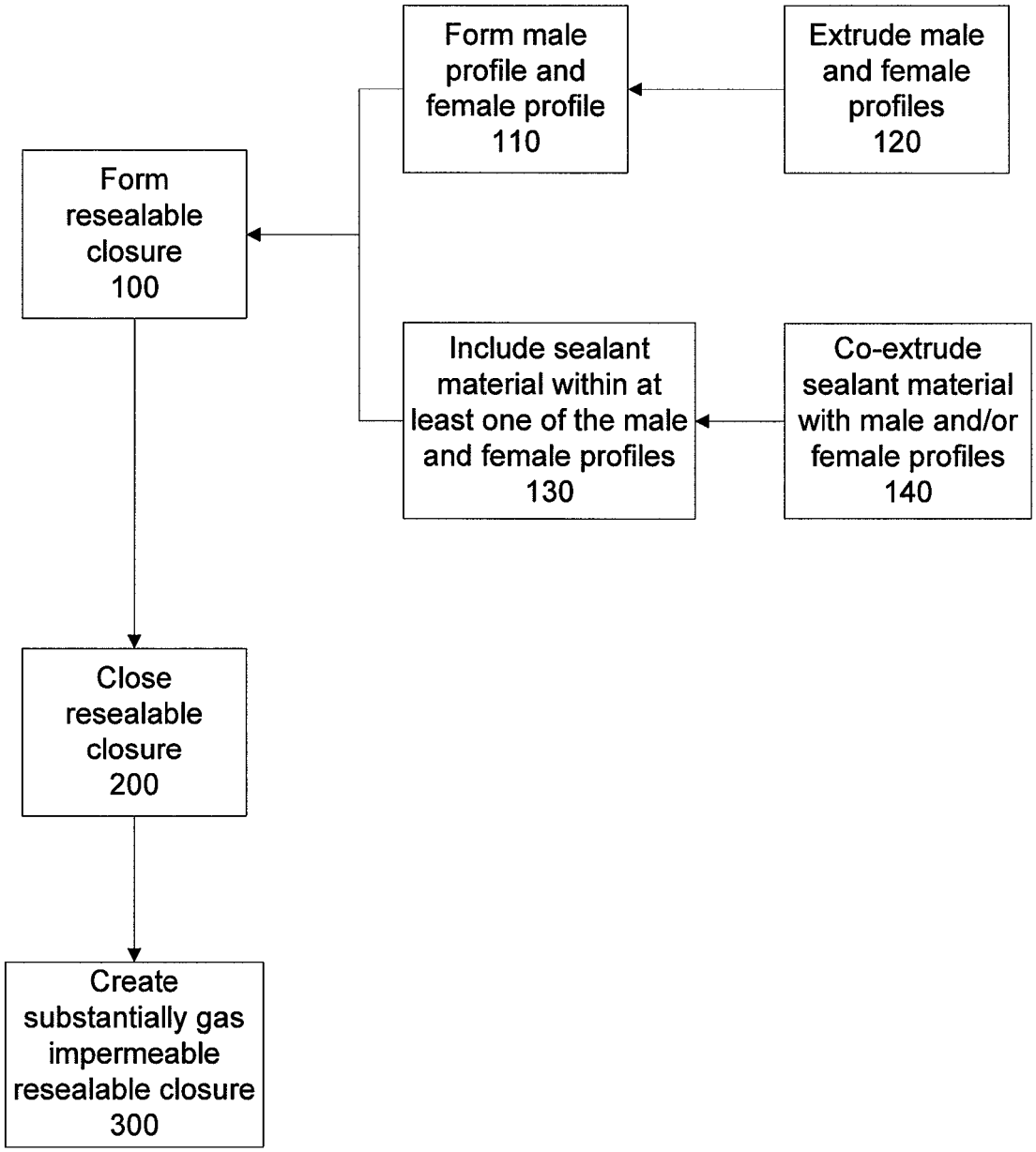
FIG. 9*b* is a block diagram illustrating one method for forming a resealable closure.

One embodiment of a method for forming a resealable closure is illustrated in FIG. 9*b*. In the illustrated embodiment, the forming a resealable closure step 100 includes at least one of the steps of forming the male profile and female profile 110, and including sealant material within at least one of the male profile and female profile 130. The male profile and female profile may be formed by any known methods. For example, a male and/or female profile may be extruded, such as via well-known techniques. To include the sealant material within at least one of the male and female profiles, the sealant material may be co-extruded with the male and/or female profile 140. More particularly, as the male and/or female profile is extruded via a die, a sealant material may be injected therein to provide the sealant material within a channel of either the male profile and/or female profile. Co-extrusion techniques are well-known, some of which are described in U.S. Pat. Nos. 5,284,710; 5,393,536; 6,817,651; and 7,078,093, each of which is incorporated herein by reference in its entirety, and various ones of these co-extrusion techniques may be used to provide a resealable closure with a sealant contained therein. In one embodiment of the present method, the step of forming the male profile and/or the female profile may be concomitant to the step of including sealant within at least one of the male profile and/or female profile.

Figure 9C:
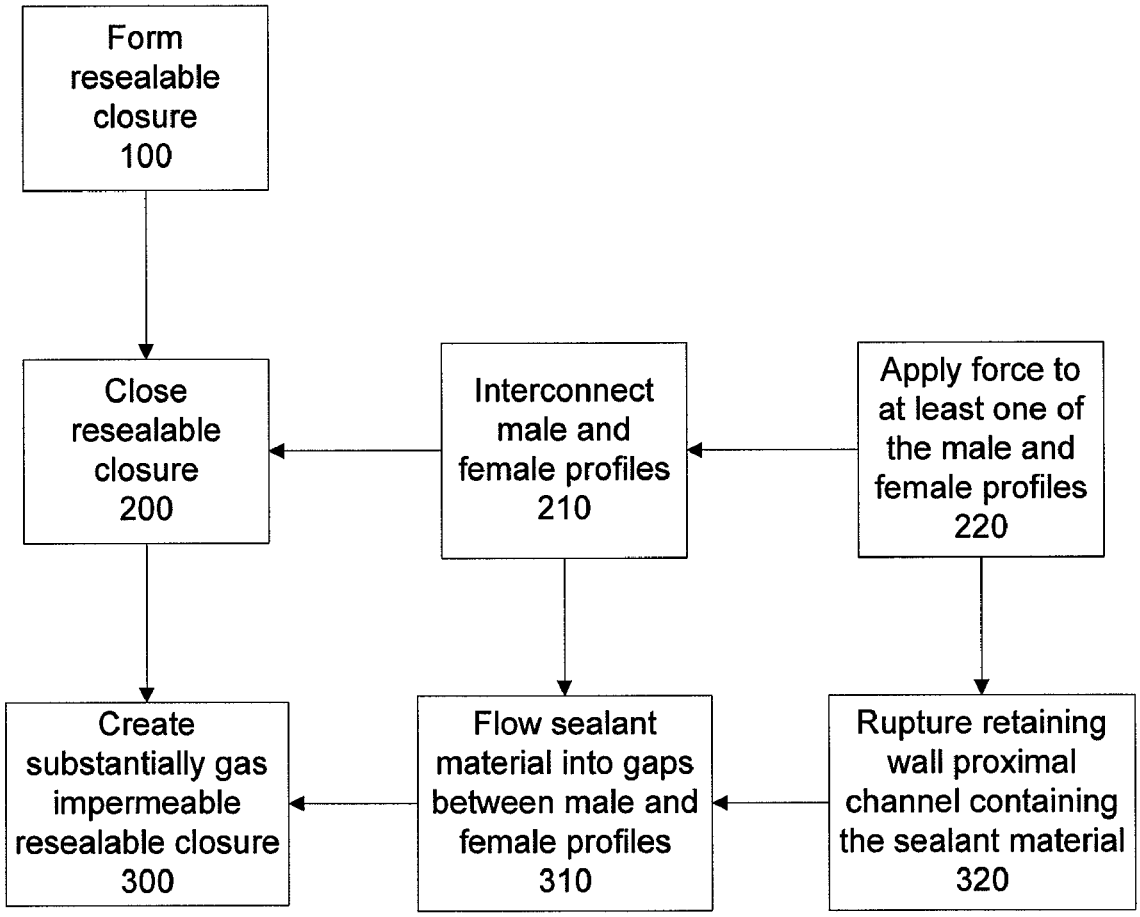
FIG. 9*c* is a block diagram illustrating one method for forming a resealable closure.

Referring now to FIG. 9*c*, after the resealable closure has been formed 100, the resealable closure may be closed 200, such as via interconnection of the male and female profiles. For example, a head of the male profile may be restrainably engaged by a restraining member of the female profile. Concomitant thereto, sealant material may flow into the gaps between the male and female profiles 310 to create a substantially gas-impermeable seal within the resealable closure 300.

The step of interconnecting the male and female profiles 210 may include the step of applying force to at least one of the male and female profiles 220 to facilitate the interconnection. In this regard, concomitant to the interconnection and/or applying force steps 210, 220, a retaining wall (e.g., a sidewall) proximal a channel containing the sealant material may be ruptured, thereby enabling fluid communication between the channel and a gap between the male profile and female profile. In turn, the sealant material may flow into and fill at least a portion of the gap. Thus, the creation of the substantially gas-impermeable resealable closure may be facilitated.

In another embodiment, the flowing sealant material into gaps between the male and female profile step 310 may be accomplished by providing a weakness, such as notches, in the male and/or female profile. In one embodiment, the weakness is not in fluid communication with the channel containing the sealant material. During the step of interconnecting the male and female profiles 210, the weakness may be compromised (e.g., at least partially break), thereby enabling fluid communication between the channel and a gap between the male profile and female profile. The weakness may be made in the male and/or female profiles during manufacture of the resealable closure and/or polymeric package, such as after co-extrusion of the sealant material and the male and/or female profiles. In this regard, a scoring machine or the like may be utilized.

In another embodiment, passageways may be included in the profile member(s) (e.g., the male profile and/or female profile) containing the sealant material, the passageways being in fluid communication with the gap between the profile members and with the sealant material. Thus, during engagement of the male and female profiles, the sealant material may flow from the channels through the passageways and into the gap between the male profile and the female profile. The passageways may naturally occur in the profile members (e.g., due to the porosity of the profile members), or the passageways may be man made. For example, a punch or the like may be utilized to make one or more passageways in the male and/or female profiles during manufacture of the resealable closure and/or polymeric package, such as after co-extrusion of the sealant material and the male and/or female profiles. The passageways may be any suitable size and shape. In one embodiment, the passageways are configured to restrict the sealant material from flowing out of the male and/or female profile prior to engagement of the male and/or female profiles.

Figure 10:
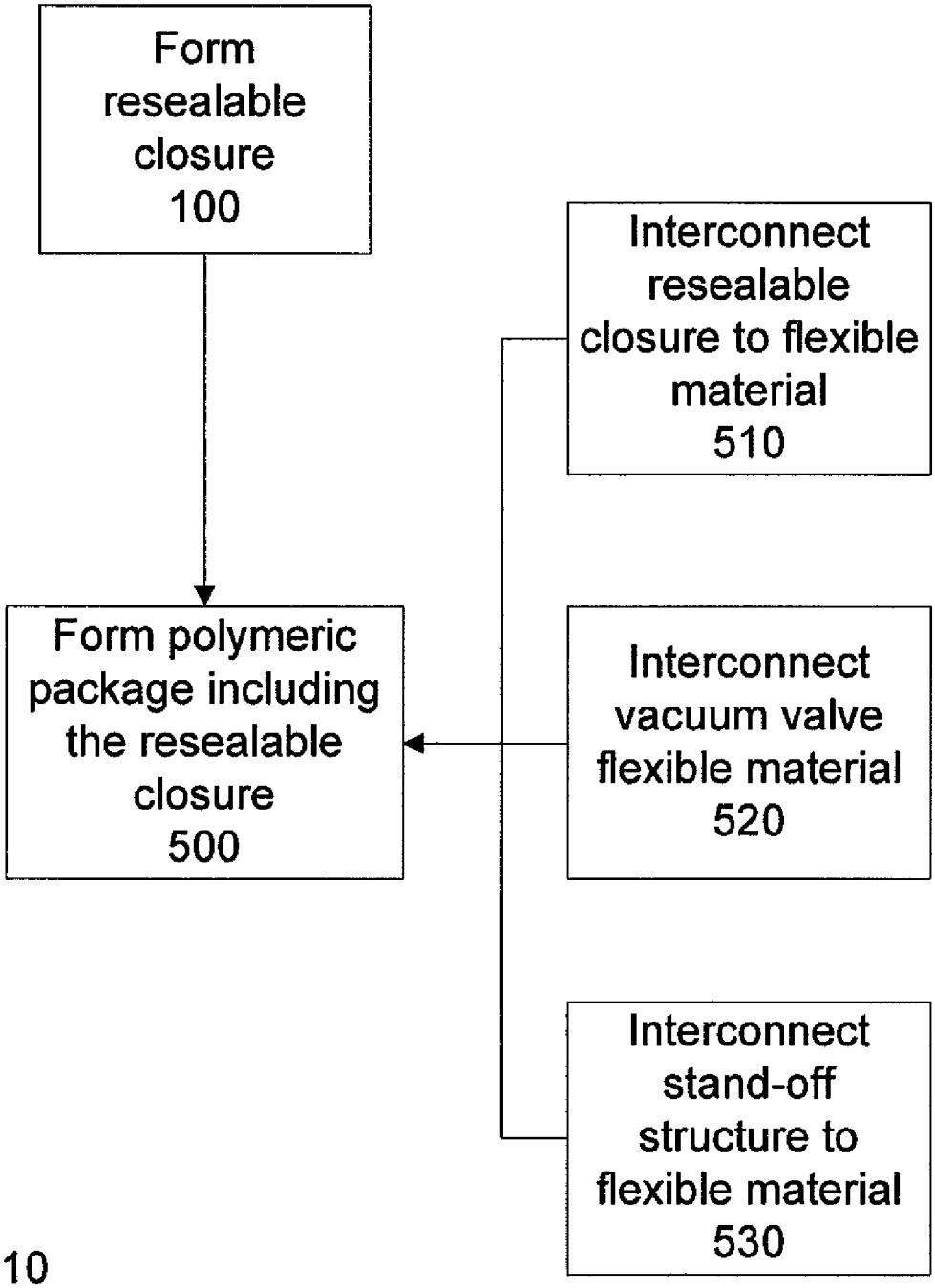
FIG. 10 is a block diagram illustrating one method for forming a polymeric package including a resealable closure.

As noted above, the resealable closure may be utilized with any of the above-described polymeric packages. In this regard, the resealable closure may be formed with the polymeric package. More particularly, and with reference to FIG. 10, a method of forming a polymeric package including the resealable closure may include the step of forming a resealable closure 100, such as described above. The method may further include the step of forming the polymeric package including the resealable closure 500. In one embodiment, the polymeric package is formed by interconnecting the resealable closure to a flexible material 510, such as a polymeric material. Upon interconnection of at least a portion of the resealable closure to the flexible material (e.g., via heat sealing, ultrasonic welding, an adhesive, and the like) the remainder of the polymeric package may be formed, such as via well-known methods. For example, the methods described above and in PCT Publication No. WO2006/012528 may be utilized to form the polymeric package. The method may also optionally include the steps of interconnecting a vacuum valve with the polymeric package 520 and interconnecting a stand-off structure with the polymeric package 530 to form the polymeric package 500 (e.g., an evacuable package).

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A resealable closure comprising:

a male profile comprising a head defined by a head sidewall;

a female profile comprising a restraining member adapted to restrainably engage the head of the male profile defined by a restraining member sidewall; and a sealant material disposed within a channel formed in at least one of the female profile and the male profile, and spaced apart from the corresponding at least one of the head sidewall and the restraining, member sidewall, wherein the sealant material flows out of the channel upon application of a sufficient force.

2. The rescalable closure of claim 1, wherein the sealant material comprises a lubricant suitable for at least incidental contact to food items.

3. The resealable closure of claim 2, wherein the sealant material is a silicone-based material.

4. The resealable closure of claim 1, wherein at least one of the head sidewall and the restraining member sidewall comprises a plurality of apertures, and the sealant material has a sufficiently high viscosity such that the sealant material will only flow out of the channel when a force is applied to at least one of the male and female profiles.

5. The resealable closure of claim 1, wherein the head sidewall has a thickness that is sufficiently thin so that when the head of the male profile engages the female profile with the sufficient force, at least a portion of the head sidewall ruptures, thereby allowing flow of the sealant material out of the channel.

6. The resealable closure of claim 1, wherein the male profile comprises a weakness at least proximal to the head sidewall, wherein the weakness is configured such that when the head of the male profile engages the female profile with the sufficient force, at least a portion of the weakness breaks, thereby at least partially rupturing the head sidewall and allowing flow of the sealant material out of the channel.

7. The resealable closure of claim 1, wherein the female profile comprises the channel, and the channel is spaced from the restraining member sidewall, and wherein the restraining member sidewall has a thickness that is sufficiently thin so that when the head of the male profile engages the female profile with the sufficient force, at least a portion of the restraining member sidewall ruptures, thereby allowing flow of the sealant material out of the channel.

8. The resealable closure of claim 1, wherein the channel includes at least one sealant-containing portion and a plurality of void spaces spaced at predetermined intervals.

9. The resealable closure of claim 8, wherein the void spaces of the channel correspond to places where a first panel and a second panel of a polymeric package are bonded together.

10. The polymeric package comprising the resealable closure of claim 1.

11. The polymeric package of claim 10, further comprising:

a vacuum valve interconnected to at least one panel of the polymeric package; and a stand-off structure within the polymeric package.

12. A resealable closure comprising:

a first complementary member;

a second complementary member adapted to interconnect with the first complementary member; and a sealant material sealed within a channel formed within the first complementary member, the channel being spaced from a sidewall of the first complementary member by a distance, the distance being sufficiently small such that upon engagement of the first and second complementary members with a sufficient force, the sidewall at least partially ruptures, thereby allowing the sealant material to flow out of the channel.

13. The resealable closure of claim 12, wherein the sealant material is sealed within a second channel of the second complementary member, the second channel being spaced from a retaining Wall of the second complementary member by a distance, the distance being sufficiently small such that upon engagement of the first and second complementary members with a sufficient force, the retaining wall at least partially ruptures, thereby allowing the sealant material to flow-out of the channel.

* * * * *